US010633140B1

(12) United States Patent
Vergara

(10) Patent No.: US 10,633,140 B1
(45) Date of Patent: Apr. 28, 2020

(54) BOXES, BLANKS AND ASSOCIATED METHODS

(71) Applicant: Armando Vergara, Lima (PE)

(72) Inventor: Armando Vergara, Lima (PE)

(73) Assignees: Surpack s.a., Lima (PE); Advan Packaging Systems LLC, Columbia, SC (US)

( * ) Notice: Subject to any disclaimer, the term of this patent is extended or adjusted under 35 U.S.C. 154(b) by 164 days.

(21) Appl. No.: 15/719,906

(22) Filed: Sep. 29, 2017

Related U.S. Application Data

(60) Provisional application No. 62/488,325, filed on Apr. 21, 2017.

(51) Int. Cl.

| | |
|---|---|
| ***B65D 5/42*** | (2006.01) |
| ***B65D 5/10*** | (2006.01) |
| ***B65B 5/10*** | (2006.01) |
| ***B65D 85/00*** | (2006.01) |
| ***B65D 5/468*** | (2006.01) |
| *B65D 5/00* | (2006.01) |

(52) U.S. Cl.
CPC ..... *B65D 5/106* (2013.01); *B65D 5/4266* (2013.01); *B65D 5/4295* (2013.01); *B65D 5/4608* (2013.01); *B65D 85/70* (2013.01); *B65B 5/10* (2013.01); *B65D 5/001* (2013.01); *B65D 5/103* (2013.01)

(58) Field of Classification Search
CPC ..... B65D 5/103; B65D 5/106; B65D 5/4295; B65D 5/001; B65B 5/10
See application file for complete search history.

(56) References Cited

U.S. PATENT DOCUMENTS

| | | | | | |
|---|---|---|---|---|---|
| 2,358,943 | A * | 9/1944 | Smith | B65D 5/6608 | 229/120 |
| 3,097,781 | A * | 7/1963 | Masi | B65D 5/001 | 229/122.26 |
| 3,201,026 | A * | 8/1965 | Travis | B65D 5/106 | 229/155 |
| 3,660,116 | A * | 5/1972 | Clark | B65D 5/4295 | 206/521.1 |
| 3,863,829 | A * | 2/1975 | Merrill | B65D 5/2047 | 206/766 |
| 3,881,648 | A * | 5/1975 | Hall | B65D 5/2047 | 229/112 |
| 5,145,067 | A * | 9/1992 | Carver | B65D 71/16 | 206/426 |
| 5,163,609 | A * | 11/1992 | Muise, Jr. | B65D 5/003 | 229/113 |

(Continued)

*Primary Examiner* — Justin M Larson
(74) *Attorney, Agent, or Firm* — Additon, Higgins & Pendleton, P.A.

(57) ABSTRACT

A fastener assembly can include a latch of a first flap and a hole of a second flap. The latch and hole can be configured to be mated together to releasably fasten the first and second flaps to one another when the first and second flaps are in an overlapping configuration. The latch can be inwardly spaced apart from each outer peripheral edge of the first flap, and the hole can be inwardly spaced apart from each outer peripheral edge of the second flap. The fastener assembly can be a variable fastener assembly configured to be in a variety of predetermined fastened configurations for securing the first and second flaps to one another in a variety of predetermined overlapping configurations.

26 Claims, 22 Drawing Sheets

(56) References Cited

U.S. PATENT DOCUMENTS 5,263,612 A * 11/1993 Nederveld ..... B65D 5/008 229/112
5,390,847 A * 2/1995 Young ..... B65D 5/0075 229/122.21
5,458,283 A * 10/1995 Southwell ..... B65D 5/0025 229/178
5,462,220 A * 10/1995 Bacchetti ..... B65D 5/001 229/112
5,503,324 A 4/1996 Bacchetti et al.
5,518,171 A 5/1996 Moss
5,642,854 A * 7/1997 Hatton ..... B65D 5/10 229/120
5,658,644 A 8/1997 Ho et al.
5,967,662 A 10/1999 Chew
5,979,655 A 11/1999 Tseng et al.
6,079,877 A 6/2000 Chew
6,102,279 A 8/2000 Dowd
6,382,429 B1 5/2002 Yeh et al.
6,481,594 B1 11/2002 Yeh et al.
6,759,114 B2 7/2004 Wu et al.
6,938,818 B2 * 9/2005 Moorman ..... B65D 5/10 229/120
8,668,132 B2 * 3/2014 Lopez Masague .... B65D 5/103 229/117
8,998,072 B2 4/2015 Whittles et al.
9,028,636 B2 5/2015 Frigge et al.
9,290,290 B2 3/2016 Carman
9,321,550 B2 4/2016 Whittles et al.
9,434,123 B2 9/2016 Carman
9,527,622 B2 12/2016 Carman
D812,468 S * 3/2018 Carman ..... D9/433
10,207,848 B2 * 2/2019 Alexander ..... B65B 5/024
10,220,975 B2 * 3/2019 Carman ..... B65D 5/0015
2004/0222542 A1 11/2004 Jan et al.
2006/0026349 A1 11/2006 Whittles
2008/0003869 A1 1/2008 Wu et al.
2008/0003870 A1 1/2008 Wu et al.
2008/0017596 A1 7/2008 Whittles et al.
2008/0175961 A1 * 7/2008 Whittles ..... A23B 9/00 426/115
2011/0036904 A1 * 2/2011 Lopez Masague .... B65D 5/103 229/126
2015/0251797 A1 * 9/2015 Carman ..... B65D 5/0254 229/148
2015/0329236 A1 * 11/2015 Deering ..... B65D 5/06 229/138
2016/0075465 A1 * 3/2016 Wiley ..... B65D 81/26 206/459.5
2016/0137333 A1 * 5/2016 Brundage ..... B65D 5/001 229/5.5
2017/0101212 A1 4/2017 Carman
2018/0009564 A1 1/2018 Carman

* cited by examiner

BOXES, BLANKS AND ASSOCIATED METHODS

CROSS-REFERENCE TO RELATED APPLICATION

This application claims the benefit of U.S. Provisional Application No. 62/488,325, filed Apr. 21, 2017, which is hereby incorporated by reference in its entirety.

FIELD OF THE INVENTION

The present invention relates to cartons and, more particularly, to boxes that may be used, for example, in agricultural settings.

BACKGROUND

Waxed cardboard boxes and wooden boxes are widely used in agricultural settings. As an improvement to such cardboard and wooden boxes, plastic boxes have been used in agricultural settings. There is a desire for further improvements.

SUMMARY

An aspect of this disclosure is the provision of a blank having first and second flaps configured to at least partially close a side of a box erected from the blank, and a fastener assembly configured to provide a fastened configuration to releasably fasten the first and second flaps to one another. The fastener assembly can include a latch of the first flap and a hole of the second flap, wherein the latch and the bole are configured to be mated together in the fastened configuration. The latch can be inwardly spaced apart from each outer peripheral edge of the first flap, and the hole can be inwardly spaced apart from each outer peripheral edge of the second flap.

The first and second flaps can be configured to be in a plurality of predetermined overlapping configurations with one another. The fastener assembly can be a variable fastener assembly configured to be in a plurality of predetermined fastened configurations for respectively releasably securing the first and second flaps to one another in the plurality of predetermined overlapping configurations.

Another aspect of this disclosure is the provision of a method including placing a plurality of articles into an interior of an upwardly open box. The box can include a plurality of panels respectively foldably connected to one another by fold lines so that the plurality of panels extends at least partially around the interior of the box. The fold lines can extend upright while the box is upwardly open. The plurality of panels can include a first pair of opposite side panels that each comprises a polymeric sheet having elongate flutes extending crosswise to the fold lines. The placing of the plurality of articles into the interior of the upwardly open box can be comprised of arranging each article of at least some of the plurality of articles so that opposite ends of the article are simultaneously respectively engaged against a second pair of opposite side panels of the plurality of panels. Then, the box can be rotated to cause the second pair of opposite side panels to respectively become top and bottom panels of the box, so that for each article of at least some of the plurality of articles, the opposite ends of the article are simultaneously respectively engaged against the top and bottom panels of the box. Then, an object, such as another box, can be placed the top panel of the initial box so that weight of the object is at least partially supported by the first pair of opposite side panels and at least some articles of the plurality of articles, so that at least some articles of the plurality of articles experience lengthwise compression.

Another aspect of this disclosure is the provision of a blank having: a plurality of panels each comprising opposite end edges and opposite side edges extending crosswise to the end edges, wherein at least some of the opposite end edges are respectively foldably connected to one another; a first flap foldably connected to a side edge of the side edges of a first panel of the plurality of panels, wherein the first flap comprises a tab; and a second flap foldably connected to a side edge of the side edges of a second panel of the plurality of panels. The second panel can at least partially define a hole, and the tab and the hole can be cooperatively configured to be mated with one another and releasably secure the first and second flaps to one another when the blank is erected into a box. The tab can include a head connected to a neck, so that head extends in an outward direction away from the neck. The head can define a taper so that opposite edges of the head extend divergently with respect to one another in the outward direction. The second panel can include one or more protrusions extending into the hole for engaging the head.

The foregoing summary provides a few brief examples and is not exhaustive, and the present invention is not limited to the foregoing examples. The foregoing examples, as well as other examples, are further explained in the following detailed description with reference to accompanying drawings.

BRIEF DESCRIPTION OF THE DRAWINGS

The drawings discussed below may be schematic and/or features depicted therein may not be drawn to scale. The drawings are provided as examples. The present invention may be embodied in many different forms and should not be construed as limited to the examples depicted in the drawings and/or described below.

FIG. 4 is representative of cross-sectional views of portions of the material from which the blank of FIG. 1 can be formed, wherein the cross sections are perpendicular to lengthwise directions of elongate flutes or passageways in the material, in accordance with the first embodiment.

FIG. 9 is a view from within the box of the first embodiment, wherein FIG. 9 depicts a portion of an interior corner of the closed end of the box, and the interior corner contains an outer fastener assembly that is securing end flaps in their inwardly closed configuration.

FIG. 10 is a view from outside the box of the first embodiment, wherein FIG. 10 depicts a portion of an outer end flap prior to the inner latching tab being struck from the outer end flap.

FIG. 13 is a view from within the box of the first embodiment, wherein FIG. 13 depicts the inner fastener assembly of FIG. 12 in the process of being fastened.

DETAILED DESCRIPTION

An aspect of this disclosure is the provision boxes, blanks that may be erected to at least partially form the boxes, and methods that may be associated with the boxes and/or blanks. As examples, embodiments of boxes, blanks, packages and methods are disclosed in the following. The present invention may, however, be embodied in many different forms and should not be construed as limited to the embodiments set forth herein. For example, features disclosed as part of one embodiment can be used in the context of another embodiment to yield a further embodiment.

Figure 1:
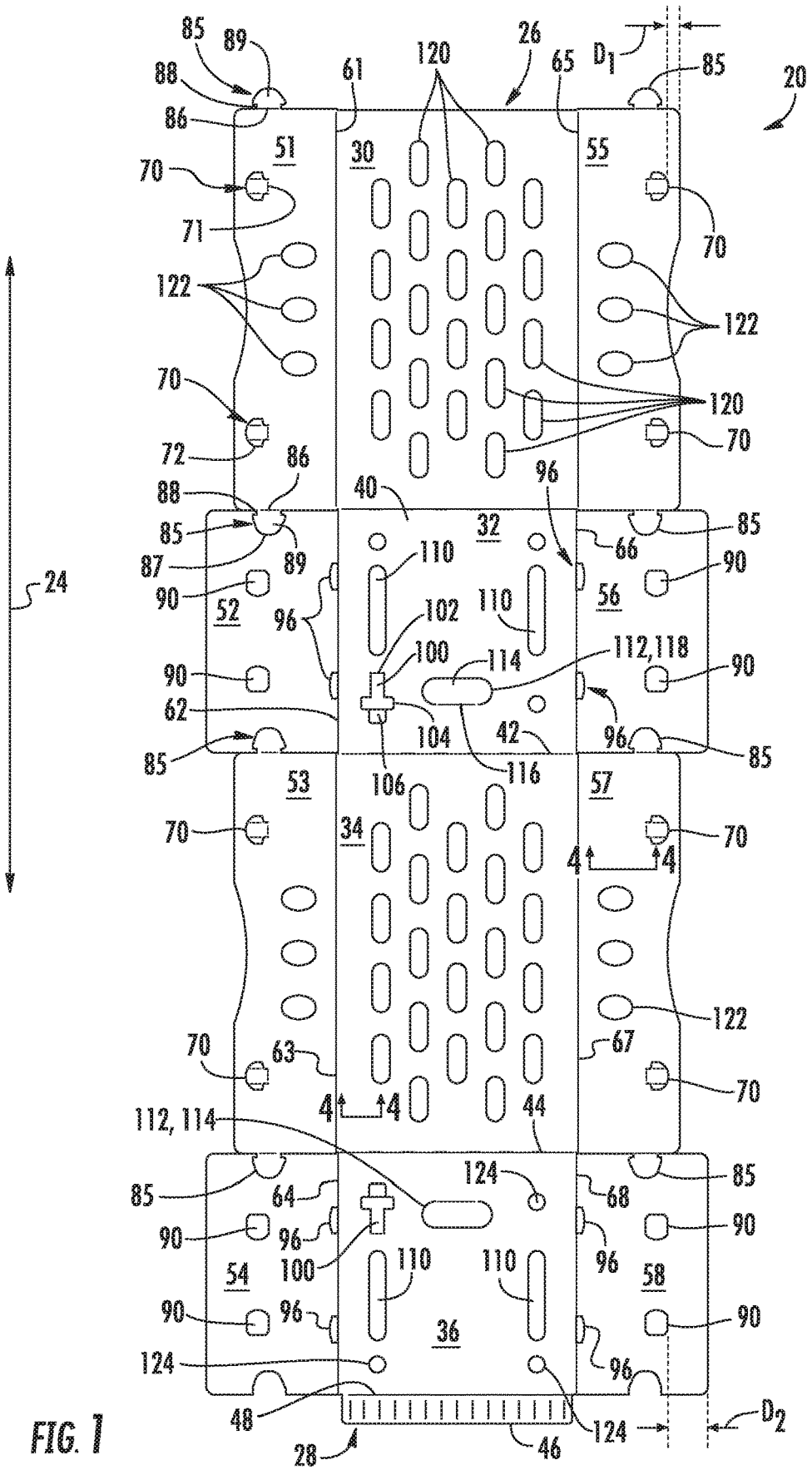
FIG. 1 is a plan view of a flat, unfolded blank that is configured to be formed into a carton or box, in accordance with a first embodiment of this disclosure.

FIG. 1 depicts a flat blank 20 configured to be formed into a carton or box 22 (FIGS. 5-8, 15-17 and 20-22), in accordance with a first embodiment of this disclosure. The blank 20 of the first embodiment can be described as extending in a longitudinal direction 24 between the opposite ends 26, 28 of the blank. In FIG. 1, the longitudinal direction 24 is schematically represented by a double-ended arrow. For providing a frame of reference that may be used in this Detailed Description section for ease of understanding, reference is frequently made to the longitudinal direction 24 (e.g., longitudinal) and a crosswise direction that extends crosswise to the longitudinal direction. Whereas this frame of reference may be used for ease of understanding, its use is not intended to limit the scope of this disclosure. For example, those of ordinary skill will understand that crosswise is not limited to perpendicular, although crosswise embraces and/or encompasses perpendicular; and they will also understand that the longitudinal direction 24 extends crosswise to the crosswise direction.

The blank 20 of the first embodiment has an overall length that extends in the longitudinal direction (e.g., longitudinally) between the blank's opposite ends 26, 28; and the blank has an overall width dimension that extends in the crosswise direction (e.g. crosswise). In the first embodiment, the blank's overall length is greater than its overall width. However, variations are within the scope of this disclosure. For example, differently configured (e.g., sized) blanks are within the scope of this disclosure. As a more specific example, it is believed that the blank 20 may alternatively have an overall width dimension that is greater than its overall length dimension. Other variations are also within the scope of this disclosure.

The blank 20 can have a series (e.g., plurality) of panels 30, 32, 34, 36 each having opposite, crosswise end edges, and some of those end edges can be foldably connected to one another along respective crosswise fold lines 40, 42, 44. More specifically, the blank 20 can include a first panel 30 connected to a second panel 32 at crosswise fold line 40, a third panel 34 connected to the second panel at crosswise fold line 42, and a fourth panel 36 connected to the third panel at crosswise fold line 44. An attachment flap 46 can be foldably connected to the outer, crosswise end edge of the fourth panel 36 at a crosswise fold line 48. Although not depicted in the drawings, the attachment flap 46 can alternatively be located at the opposite end of the blank 20, so that the attachment flap is connected to the outer, crosswise end edge of the first panel 30.

The blank 20 can further include closure flaps 51-58 respectively foldably connected to opposite, longitudinal side edges of the panels 30, 32, 34, 36. More specifically, the blank 20 can include a first series of flaps 51-54 at a first side of the blank, and a second series of flaps 55-58 at a second side of the blank. Even more specifically, the blank 20 can include a first flap 51 connected to a first longitudinal side edge of the first panel 30 at longitudinal fold line 61, a second flap 52 connected to a first longitudinal side edge of the second panel 32 at longitudinal fold line 62, a third flap 53 connected to a first longitudinal side edge of the third panel 34 at longitudinal fold line 63, and a fourth flap 54 connected to a first longitudinal side edge of the fourth panel 36 at longitudinal fold line 64. Similarly, the blank 20 can include a fifth flap 55 connected to a second longitudinal side edge of the first panel 30 at longitudinal fold line 65, a sixth flap 56 connected to a second longitudinal side edge of the second panel 32 at longitudinal fold line 66, a seventh flap 57 connected to a second longitudinal side edge of the third panel 34 at longitudinal fold line 67, and a fourth flap 58 connected to a second longitudinal side edge of the fourth panel 36 at longitudinal fold line 68. As depicted in FIG. 1, adjacent longitudinal fold lines 61-68 can be offset from one another, for example to compensate for the thickness of the blank 20 and/or for other reason(s).

As will be discussed in greater detail below, when the blank 20 is formed into a carton or box: the first and third panels 30, 34 can each function as, and thus may also be referred to as, side panels 30, 34; the second and fourth 32, 36 panels can each function as, and thus may also be referred to as, end panels 32, 36; the first, third, fifth and seventh flaps 51, 53, 55, 57 can function as, and thus may also be referred to as, outer flaps 51, 53, 55, 57; and the second, fourth, sixth and eighth flaps 52, 54, 56, 58 can function as, and thus may also be referred to as, inner flaps 52, 54, 56, 58. Notwithstanding the foregoing, naming and relationships between the features of the blank 20 can vary. For example, the blank 20 can be configured or oriented differently than depicted in FIG. 1, such as by the blank being turned over and/or rotated so that the attachment flap 46 is at the top end 26 rather than the bottom end 28.

In the first embodiment, each of the outer flaps 51, 53, 55, 57 can be the same, or generally or substantially the same, as compared to one another, except for their respective locations; therefore, the following discussion of the first flap 51 is descriptive of each of the outer flaps. The first flap 51 can include one or more latches that can be tabs, wherein these tabs may be referred to as inner latching tabs 70 for ease of understanding. In the first embodiment, the inner latching tabs 70 are positioned inwardly relative to each of the outer peripheral edges of the first flap, wherein the outer peripheral edges together define the outer perimeter of the first flap.

Referring to the representative inner latching tab 70 closest to the top right corner of FIG. 1, in the first embodiment, the smallest distance D1 between the representative inner latching tab and the closest outer peripheral edge of the fifth flap 55 is about 13.5 mm. More generally, the smallest distance D1 between the representative inner latching tab 70 and the closest outer peripheral edge of the fifth flap 55 can be at least about 10 mm, in a range of from about 10 mm to about 17 mm, at least about 11 mm, in a range of from about 11 mm to about 16 mm, at least about 12 mm, or in a range of from about 12 mm to about 15 mm, including all values and subranges therebetween for each of the above.

Figure 2:
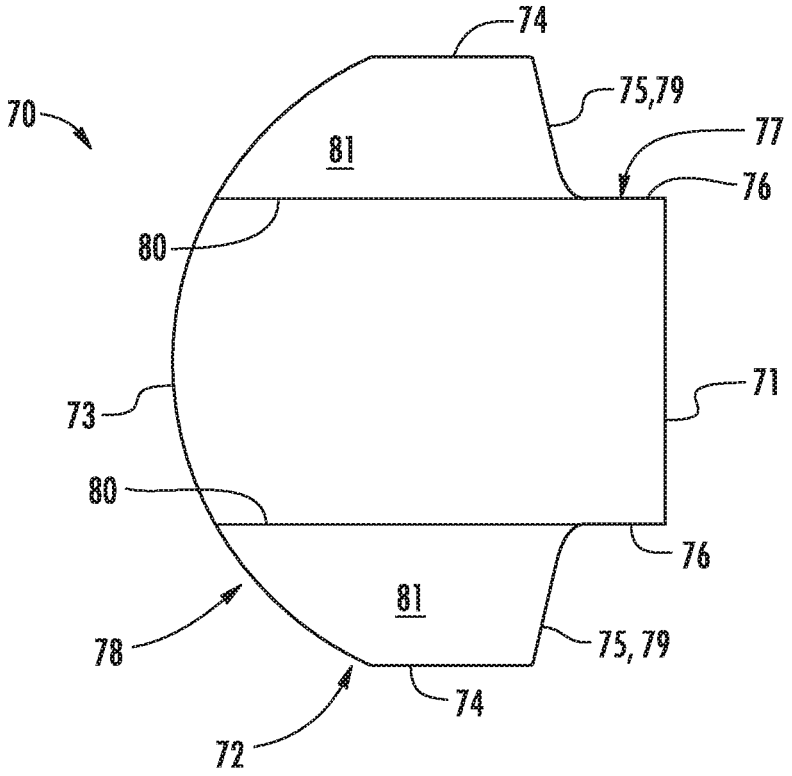
FIG. 2 is an enlarged, isolated view of a representative inner latching tab of the blank of FIG. 1.

Referring to FIG. 2, the representative inner latching tab 70 can be defined by (e.g., at least partially defined by) a longitudinal fold line 71 in the first flap 51 (FIG. 1) and a cut 72 (e.g., curved slit) extending through the first flap, from (e.g., from proximate) one end of the longitudinal fold line 71 to (e.g., to proximate) the opposite end of the longitudinal fold line 71. The curved cut or slit 72 can have an arcuate or convex section 73, longitudinal sections 74 extending from the opposite ends of the arcuate section 73, one or more oblique or crosswise sections 75 extending inwardly from the longitudinal sections 74, and longitudinal sections 76 extending inwardly from the crosswise sections 75 to (e.g., to positions that are proximate) opposite ends of the longitudinal fold line 71. The longitudinal fold line 71 and slit 72 can be cooperatively configured so that the inner latching tab 70 has a neck 77 extending outwardly from the longitudinal fold line 71 to a head 78 of the inner latching tab 70. The head 78 can be wider than the neck 77, so that the head includes one or more outwardly extending engagement edges 79 extending outwardly from the neck. The head 78 can include crosswise fold lines 80 that are respectively approximately in line with and extend from (e.g., extend from proximate) the crosswise slit sections 75 to (e.g., to proximate) the arcuate slit section 73 to at least partially define opposite flaps 81 of the head 78. As depicted in the example of FIG. 1, the longitudinal fold lines 71 and curved slits 72 are spaced apart from each of the outer peripheral edges of the first flap 51 so that the inner latching tabs 70 are spaced apart from each of the outer peripheral edges of the first panel. Differently configured inner latching tabs 70 are within the scope of this disclosure. For example, the arcuate section 73 of the cut or slit 72 can optionally be replaced with a straight slit section and/or a cutout, or the like.

Referring to FIG. 1, the first flap 51 can further include, or have connected thereto for pivoting therewith, one or more latches that can be tabs, wherein these tabs may be referred to as outer latching tabs 85 for ease of understanding. The outer latching tabs 85 can be respectively connected to opposite, outer crosswise peripheral edges of the first flap 51 by crosswise fold lines 86. Referring in FIG. 1 to the first flap 51, its lower outer latching tab 85 can be defined by (e.g., at least partially defined by) the crosswise fold line 86 in the first flap 51 and a cut 87 (e.g., curved slit) extending through the second flap 52, from one end of the crosswise fold line 86 to the opposite end of the crosswise fold line 86. The curved cut or slit 87 can have an arcuate or convex section, crosswise sections extending inwardly from the opposite ends of the arcuate section, and longitudinal sections extending from inner ends of the crosswise sections to opposite ends of the crosswise fold line 86. The crosswise fold line 86 and curved slit 87 can be cooperatively configured so that the outer latching tab 85 has a neck 88 extending outwardly from the crosswise fold line 86 to a head 89 of the outer latching tab 85. The head 89 can be wider than the neck 88 so that the head 89 includes outwardly extending engagement edges 84 (FIG. 9) extending outwardly from the neck 88. The 86 crosswise fold lines 86 interrupt cuts (e.g., slits) between adjacent crosswise outer peripheral edges of the flaps 51-58.

In the first embodiment, each of the inner flaps 52, 54, 56, 58 can be the same, or generally or substantially the same, as compared to one another, except for their respective locations; therefore, the following discussion of the second flap 52 is descriptive of each of the inner flaps. In the first embodiment, the second flap 52 comprises one or more latch keepers, each comprising a hole 90 in the second flap and a portion of the second flap that is adjacent to the hole 90, wherein the hole 90 may be referred to as an inner keeping hole 90 for ease of understanding. In the first embodiment, the inner keeping holes 90 extend through the second flap 52, are positioned inwardly relative to each of the outer peripheral edges of the second flap, and are configured to form inner fastener assemblies with respective inner latching tabs 70, as will be discussed in greater detail below. The outer peripheral edges of the second flap 52 together define the outer perimeter of the second flap.

In the first embodiment and with reference to the representative inner keeping hole 90 closest to the bottom right corner of FIG. 1, the smallest distance D2 between the representative inner keeping hole 90 and the farthest outer peripheral edge of the eighth flap 58 is about 49.5 mm. More generally, the smallest distance D2 between the representative inner keeping hole 90 and the farthest outer peripheral edge of the eighth flap 58 can be at least about 37 mm, in a range of from about 37 mm to about 62 mm, at least about 40 mm, in a range of from about 40 mm to about 59 mm, at least about 43 mm, in a range of from about 43 mm to about 56 mm, at least about 46 mm, in a range of from about 46 mm to about 53 mm, including all values and subranges therebetween for each of the above.

Figure 3:
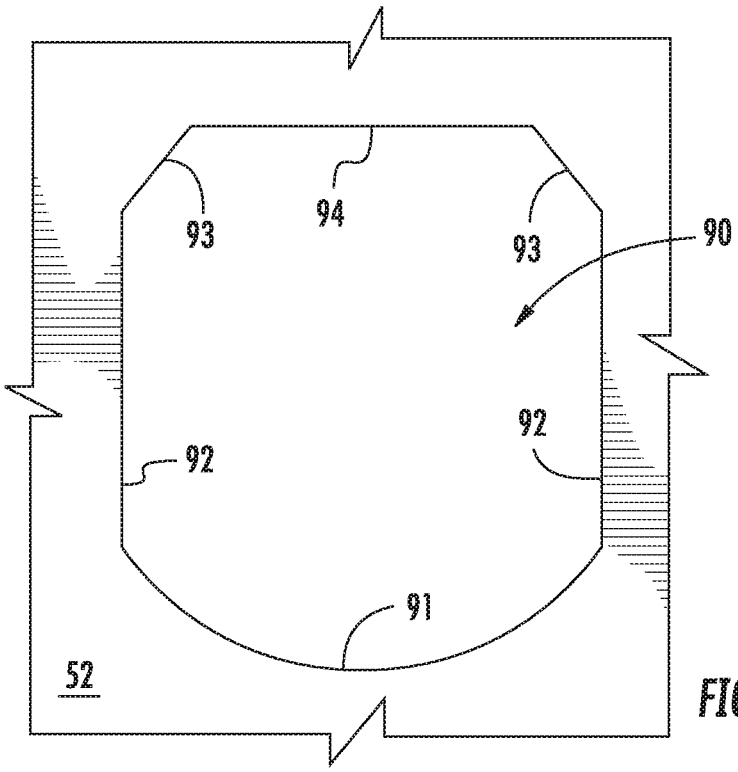
FIG. 3 is an enlarged, substantially isolated view of a representative inner keeping hole of the blank of FIG. 1, wherein the inner keeping hole of FIG. 3 is configured to receive the inner latching tab of FIG. 2 to form an inner fastener assembly.

Referring to FIG. 3, the representative inner keeping hole 90 can include, or be defined by, an annular series of inner edges 91-94 of the second flap 52 that extends around, and defines, the inner keeping hole. The series of inner edges 91-94 of the second flap 52 can include an arcuate or concave edge 91, longitudinal edges 92 extending from (e.g., from proximate) the opposite ends of the arcuate edge 91, oblique edges 93 extending convergently toward one another from (e.g., from proximate) ends of the longitudinal edges 92, and a crosswise edge 94 extending from (e.g., from proximate) and between ends of the oblique edges 93. The crosswise edge 94 and oblique edges 93 can define a tapered, relatively narrow end section of the inner keeping hole 90 due to the oblique edges 93 extending convergently toward one another. Referring also to FIG. 1, the series of inner edges 91-94 are spaced apart from each of the outer peripheral edges of the second flap 52 so that the inner keeping holes 90 of the second panel 52 are spaced apart from each of the outer peripheral edges of the first panel.

Referring to FIG. 1, the second flap 52 can further at least partially define or include one or more latch keepers comprising outer keeping holes 96. In the first embodiment, the outer keeping holes 96 extend through the second flap 52, are positioned proximate an inner longitudinal edge of the second flap, and are configured to form outer fastener assemblies with respective outer latching tabs 85, as will be discussed in greater detail below.

In the first embodiment, each of the end panels 32, 36 can be the same, or generally or substantially the same, as compared to one another, except for their respective locations; therefore, the following discussion of the second panel 32 is descriptive of each of the end panels. The second panel 32 can include at least one support tab 100 that may, for example, be T-shaped or in any other suitable shape for performing its function, as will be discussed in greater detail below. The support tab 100 can be defined by (e.g., at least partially defined by) a crosswise fold line 102 in the second panel 32, and a cut 104 (e.g., curved slit) extending through the second panel, from (e.g., from proximate) one end of the crosswise fold line 102 to (e.g., to proximate) the opposite end of the crosswise fold line 102. The curved slit or cut 104 can define or be associated with, or include a wide section in the form of, an access hole 106 extending through the second panel 32 so that the access hole 106 is contiguous with and defines an edge of the support tab 100. The curved cut or slit 104 can include opposite U-shaped or C-shaped sections, or the like, having legs extending outwardly from (e.g., from proximate) the access hole 106, and longitudinal sections extending from (e.g., from proximate) the U or C-shaped sections to (e.g., to proximate) opposite ends of the crosswise fold line 102.

The second panel 32 can include one or more handles that may include handle holes extending through the second panel. In the first embodiment, the second panel 32 includes one or more longitudinally extending handle holes 110 respectively proximate opposite longitudinal outer peripheral edges of the second panel, and a crosswise extending handle hole 112 proximate a crosswise outer peripheral edge of the second panel. A handle flap 114 can be positioned in the crosswise handle hole 112. The handle flap 114 can be foldably connected to a reminder of the second panel by a crosswise fold line 116, and the handle hole 112 can be defined by a cut 118 (e.g., slit) extending from (from proximate to) and between opposite ends of the crosswise fold line 116.

As will be discussed in greater detail below, in addition to forming a handle for being manually gripped, one or more of the handle holes 110, 112 can be configured to at least partially function to provide ventilation or drainage, and the blank 20 can include one or numerous additional ventilation or drainage holes 120, 122, 124 extending through its respective panels and/or flaps. At least some of the holes 120, 122, 124 can be elongate, for example by virtue of having a length greater than a width.

Figure 4:
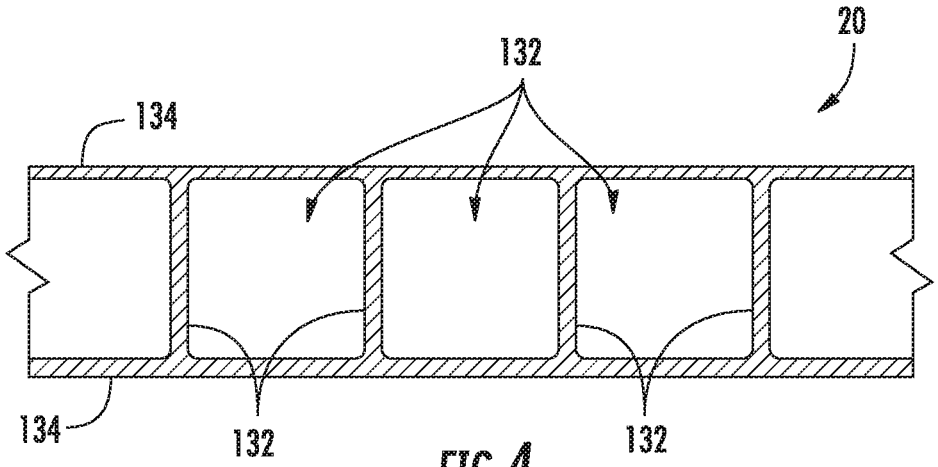
FIG. 4 is an enlarged cross-sectional view of representative portions of the blank of FIG. 1 taken along lines 4-4 of FIG. 1.

Referring also to FIG. 4, the blank 20 of the first embodiment is formed of (e.g., cut from) an extruded polymeric sheet having elongate, interior passageways or elongate flutes 130 that extend in the longitudinal direction 24 (FIG. 1) of the blank, wherein the polymeric sheet is cut, scored and/or otherwise processed to form the respective features of the blank. More specifically, in the first embodiment, the blank 20 (e.g., the base material of the blank) comprises, consists essentially of, or consists of, a polymeric sheet having connector webs 132 integrally formed with, connecting, and spanning crosswise (e.g., perpendicular to) opposite walls 134 of the polymeric sheet. In the first embodiment, each of the elongate connector webs 132 extend in the longitudinal direction 24 (FIG. 1) of the blank, and the connector webs 132 are serially spaced apart from one another in a direction extending crosswise the longitudinal direction. The polymeric sheet can be constructed of polypropylene or any other suitable polymeric materials. In alternative embodiments, the webs may define wavy or undulating shapes, the polymeric sheet can be a corrugated polymeric sheet, and the polymeric sheet can be replaced by other suitable materials, for example paperboard or cardboard, corrugated paperboard or cardboard, and/or any other suitable material. Optionally, the polymeric sheet and/or other suitable sheet material of the blank 20 can be coated and/or laminated together with one or more additional layers of suitable material.

At least partially reiterating from above, blanks 20 can be formed from fluted and/or corrugated plastic (e.g., polymeric) sheets, and those blanks may be formed into plastic boxes 22 (FIGS. 5-8, 15-17 and 20-22). As will be discussed in greater detail below, plastic boxes 22 of this disclosure can be used, for example, by corn growers as an alternative to waxed cardboard boxes and wooden boxes. It is believed that the plastic boxes 22 can provide, for example, an eco-friendly solution for the market by being 100% recyclable boxes that may be used to replace the waxed cardboard boxes and the wooden boxes. Generally described, plastic boxes 22 may be used to contain agricultural products such as, but not limited to, ears of corn, celery, broccoli, cabbage and other suitable fresh vegetables for processing and shipping. As will be discussed in greater detail below, the elongate corrugations or elongate flutes 130 (FIG. 4) in the boxes 22 can be oriented in a manner that seeks to improve, for example, the stacking strength of the boxes. In this Detailed Description section of this disclosure, corn is often discussed. Notwithstanding, at each occurrence, a reference to corn may be replaced with a reference to any other suitable article, for example "celery" or any other suitable vegetable.

Figure 5:
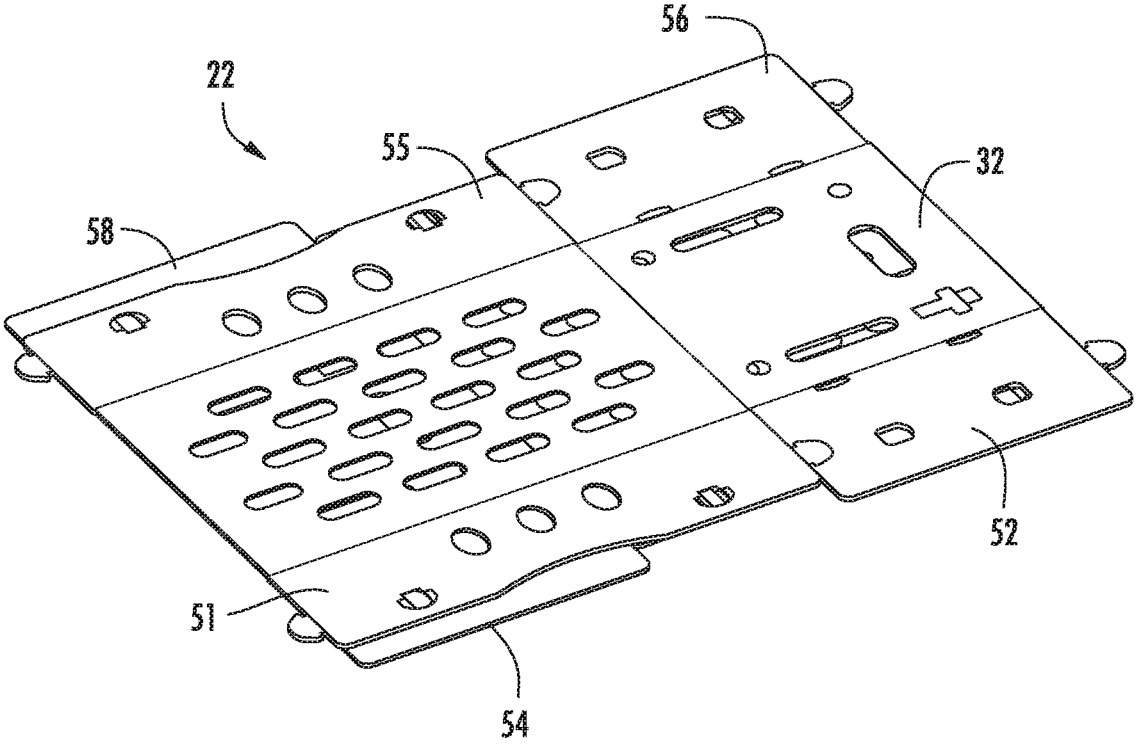
FIG. 5 depicts a folded flat sleeve, carton or box formed from the blank of FIG. 1, in accordance with the first embodiment.

Referring to FIGS. 1 and 5, the blank 20 can be converted into a collapsed sleeve or collapsed box 22 by folding along respective crosswise fold lines 40, 42, 44, 48 and fixedly fastening the attachment flap 46 to an interior, marginal portion of the first panel 30. The connection between the attachment flap 46 and first panel 30 can comprise or be made by way of adhesive material, ultrasonic bonding and/or the use of other suitable fastening techniques. The collapsed box 22 of FIG. 5 can be erected into the configuration depicted in FIG. 6 by further folding along the crosswise fold lines 40, 42, 44, 48.

Figure 6:
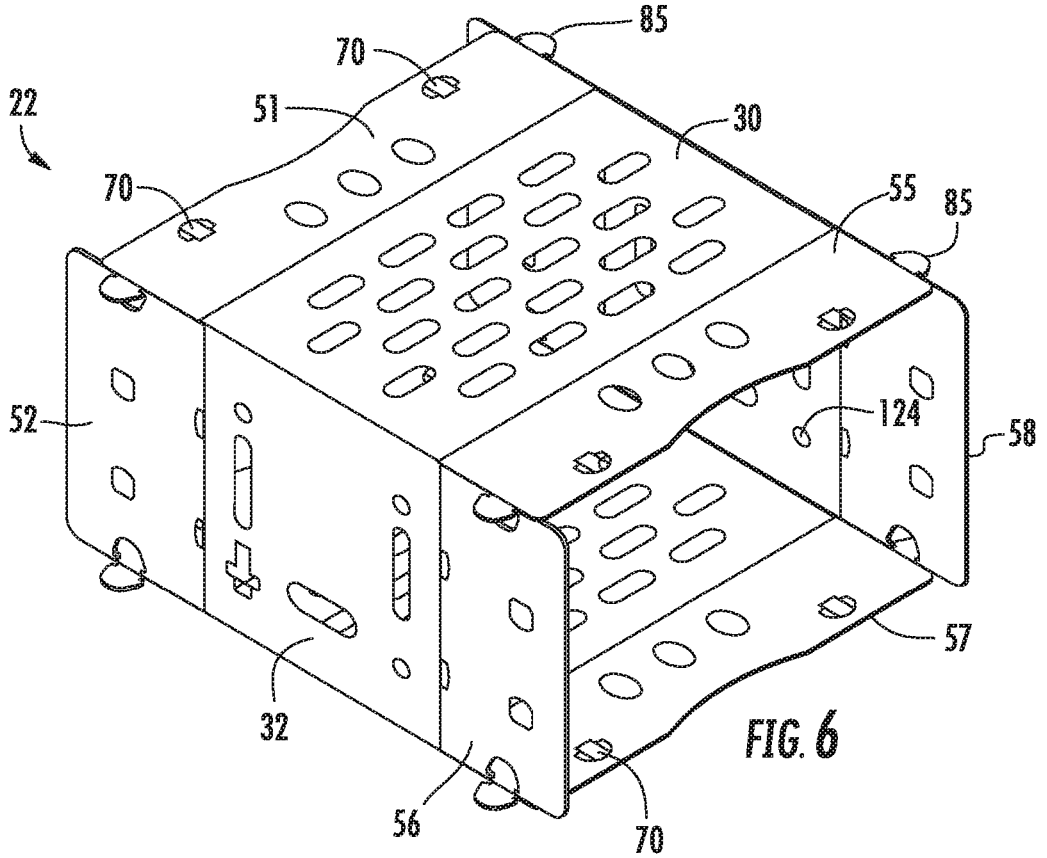
FIG. 6 depicts the box of FIG. 5 in an at least partially erected configuration, wherein the opposite ends of the box are open.
Figure 7:
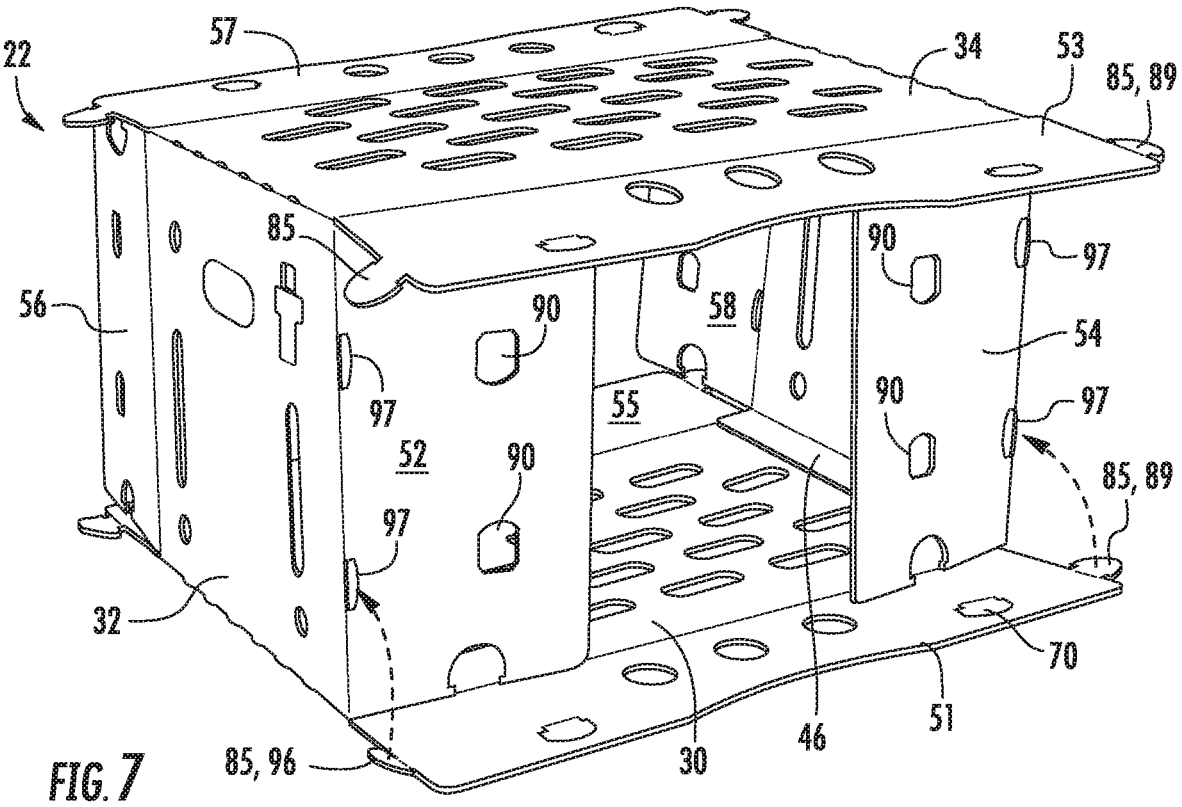
FIG. 7 depicts the box of FIG. 6 with its distal end open and its proximal end partially closed.
Figure 8:
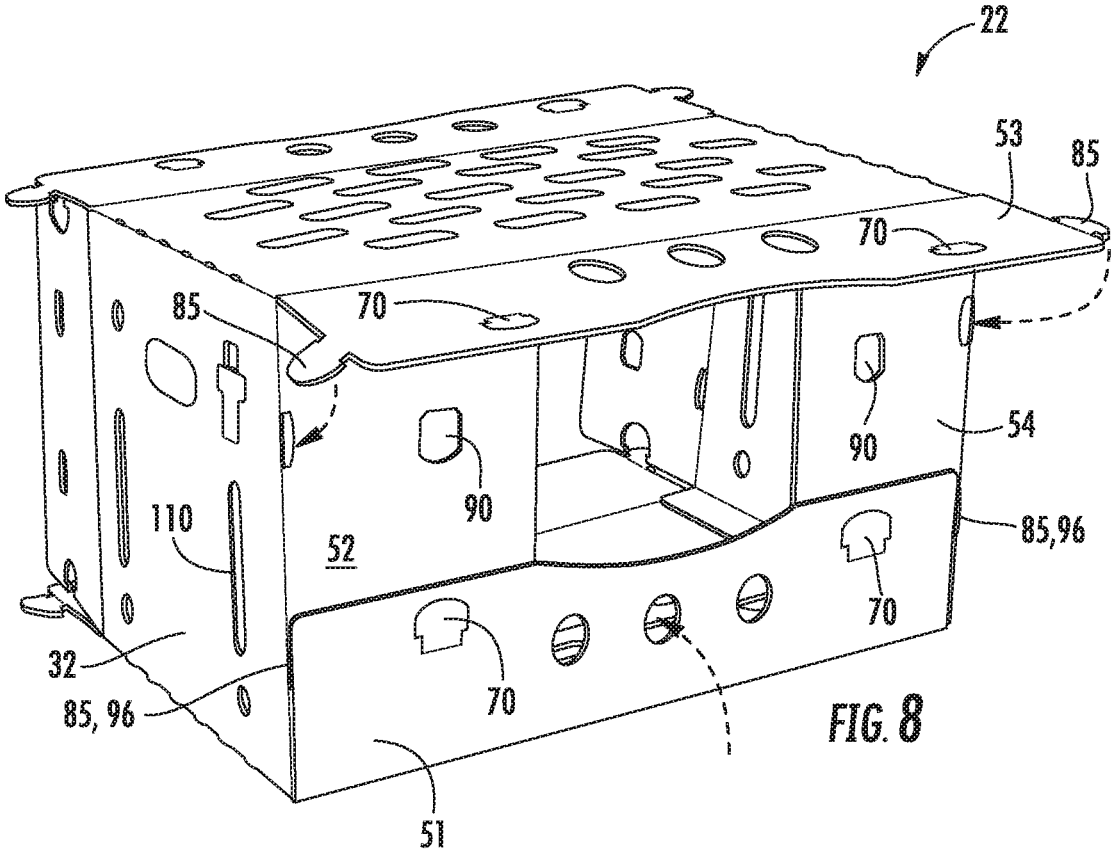
FIG. 8 depicts a further step in closing the proximal end of the box of FIG. 7.

FIG. 6 depicts the erected box 22 with opposite open ends, and FIGS. 7 and 8 depict steps of a method of closing a proximal end of the box 22 with the flaps 51-54, in accordance with the first embodiment. The method of closing the proximal end of the box 22 can include folding each of the flaps 51-54 inwardly 90 degrees (about 90 degrees) so that they extend perpendicularly to the panels 30, 32, 34, 36. More specifically, the method can include folding the inner flaps 52, 54 inwardly, and then folding the outer flaps 51, 53 inwardly so that the outer flaps 51, 53 overlap and are in opposing face-to-face relation (e.g., face-to-face contact) with the inner flaps 52, 54. The flaps 51-54 can be at least partially secured (e.g., releasably secured) in their closed configurations by fastening outer lock or fastener assemblies. Each outer fastener assembly can include at least one outer latching tab 85 mated with at least one corresponding outer keeping hole 96. Accordingly, the outer fastener assemblies may be referred to as "outer fastener assemblies 85, 96."

Referring to FIGS. 7 and 8, outer fastener assemblies 85, 96 can be fastened by folding inwardly the outer latching tabs of 85 of the outer flaps 51, 53, and inserting the outer latching tab heads 89 through the respective outer keeping holes 96 of the inwardly-folded inner flaps 52, 54. Each outer latching tab 85 can be configured to be moved through the respective outer keeping hole 96 in a first direction so that the neck 88 is positioned in the outer keeping hole and the head 89 is restricted from moving through the outer keeping hole in a second direction that is opposite the first direction.

Figure 9:
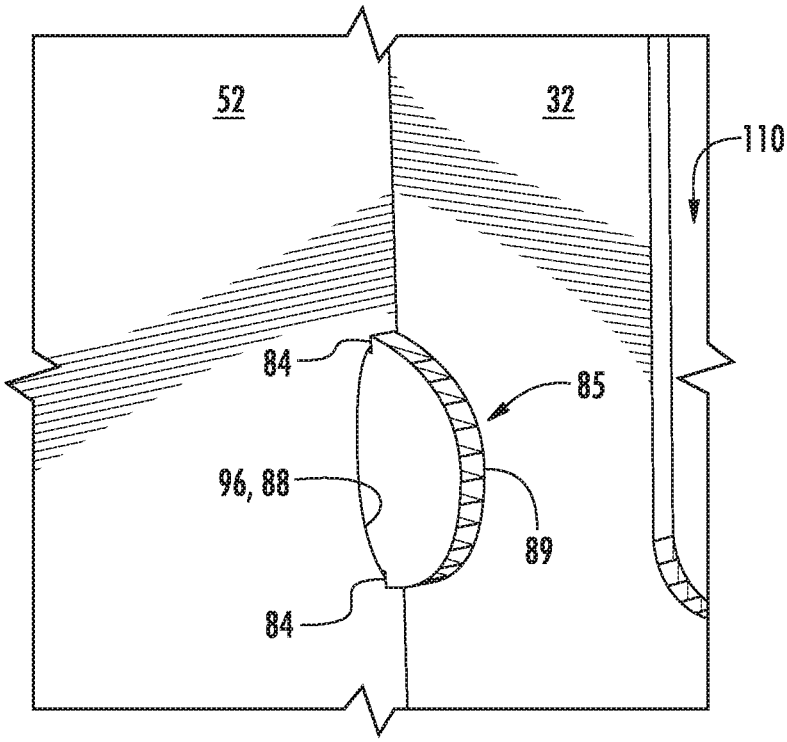

Referring also to the representative interior portion of the box 22 depicted in FIG. 9, each outer latching tab head 89 can elastically deform as it is passed (e.g., pushed inwardly) through the respective outer keeping hole 96, and after passing through the outer keeping hole the outer latching tab head 89 can elastically return to its original shape (e.g., substantially return to its original shape) so that the outer latching tab 85 is secured in the outer keeping hole 96 to fasten an outer fastener assembly 85, 96 that releasably secures the respective flaps in their inwardly closed configuration. That is, each fastened outer fastener assembly 85, 96 can include an outer latching tab 85 extending through and mated with an outer keeping hole 96. FIG. 9 depicts a representative outer fastener assembly 85, 96 in its fastened configuration. In the fastened configuration of the outer fastener assembly 85, 96, the neck 88 extends through the outer keeping hole 96 so that the head's outwardly extending engagement edges 84 engage the interior surface of the inner flap 52. Each outer fastener assembly 85, 96 is typically secure enough in its fastened configuration to remain fastened during typical usage of the box 22. However, each outer fastener assembly 85, 96 is typically also releasable or openable, by reversing the process of fastening the outer fastener assembly, or the like.

Figure 10:
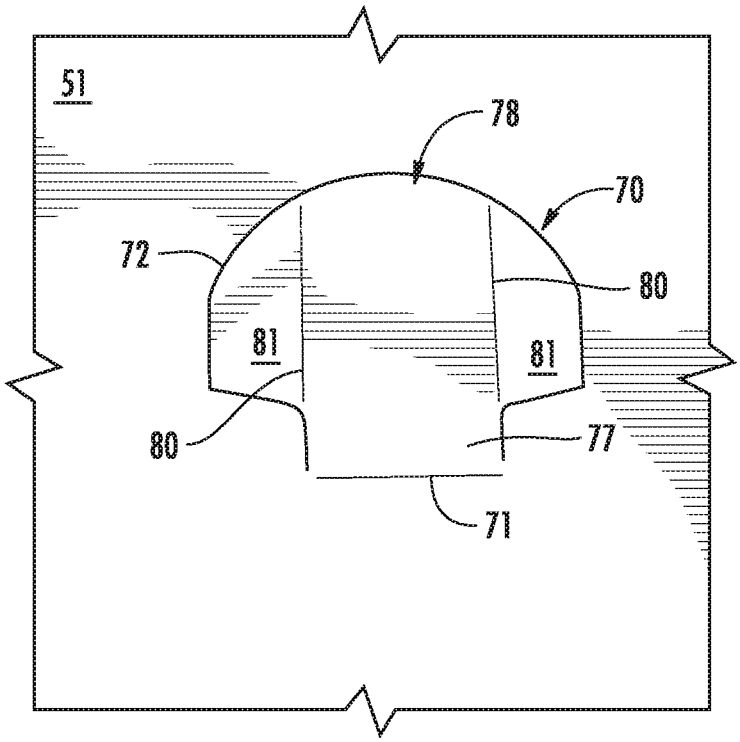
Figure 11:
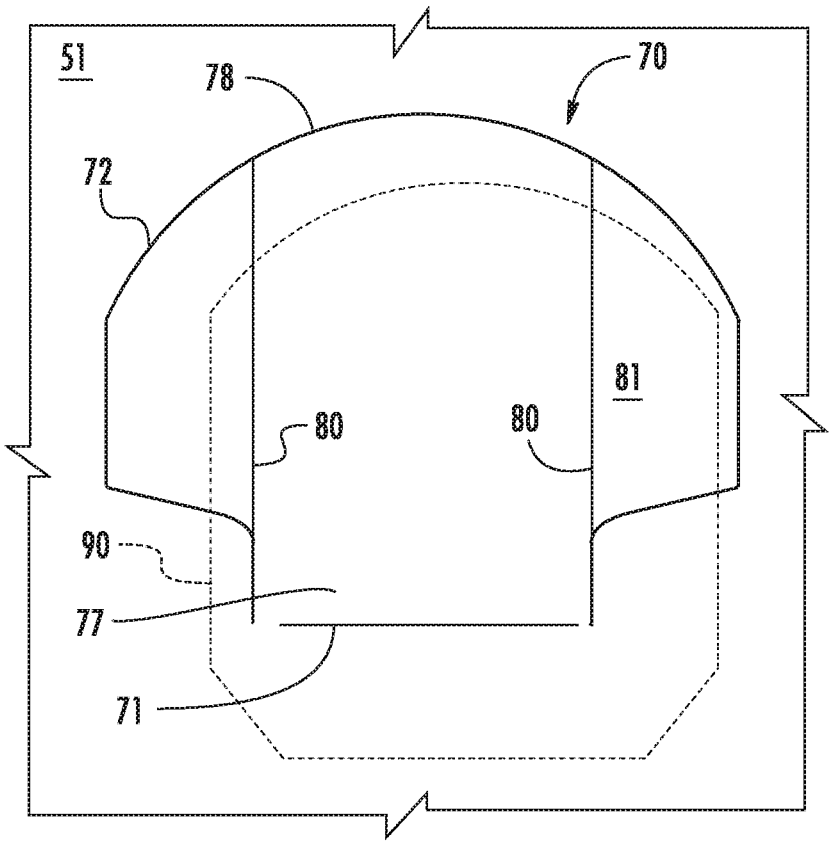
FIG. 11 is similar to FIG. 10, and further schematically depicts the un-struck inner latching tab at least partially superposed with a respective inner keeping hole in a closed end of the box of the first embodiment.

FIG. 10 is a view from outside of a closed end of the box 22, and FIG. 10 depicts a portion of a representative outer flap 51 that includes an inner latching tab 70 prior to the inner latching tab being struck from the outer end flap, in accordance with the first embodiment. For each unstruck inner latching tab 70 in each closed end of the box 22 of the first embodiment, the inner latching tab 70 is at least partially superposed with a respective inner keeping hole 90, for example as schematically shown in FIG. 11 for a representative inner latching tab 70 and associated inner keeping hole 90. In FIG. 1, the representative inner keeping hole 90 is hidden from view behind the outer flap 51; therefore, the inner keeping hole is schematically depicted with dashed lines. The inner latching tab 70 can simultaneously be at least partially superposed with, and also eccentrically arranged with respect to, the respective inner keeping hole 90, as schematically shown in FIG. 11.

In accordance with an example of a method of closing one or more ends of the box 22 of the first embodiment, after closing an end of the box with the flaps 51-54 as discussed above, optionally including fastening each of the outer fastener assemblies 85, 96 (e.g., lock assemblies) of the flaps 51-54 as discussed above, the flaps 51-54 can be further secured (e.g., releasably secured) in their closed configurations by fastening inner lock or fastener assemblies. Each inner fastener assembly can include at least one inner latching tab 70 mated with at least one corresponding inner keeping hole 90. Accordingly, the inner fastener assemblies may be referred to as "inner fastener assemblies 70, 90."

In the first embodiment, a method of fastening the inner lock or fastener assemblies of the flaps 51-54 can include folding inwardly the inner latching tabs of 70 of the inwardly-folded outer flaps 51, 53 so that the inner latching tab heads 78 pass through the respective inner keeping holes 90 of the inwardly-folded inner flaps 52, 54. Each inner latching tab 70 can be configured to be moved (e.g., manually pushed inwardly) through the respective inner keeping hole 90 in a first direction so that the neck 77 is positioned in the inner keeping hole and the head 78 is restricted from moving through the inner keeping hole in a second direction that is opposite the first direction.

Figure 12:
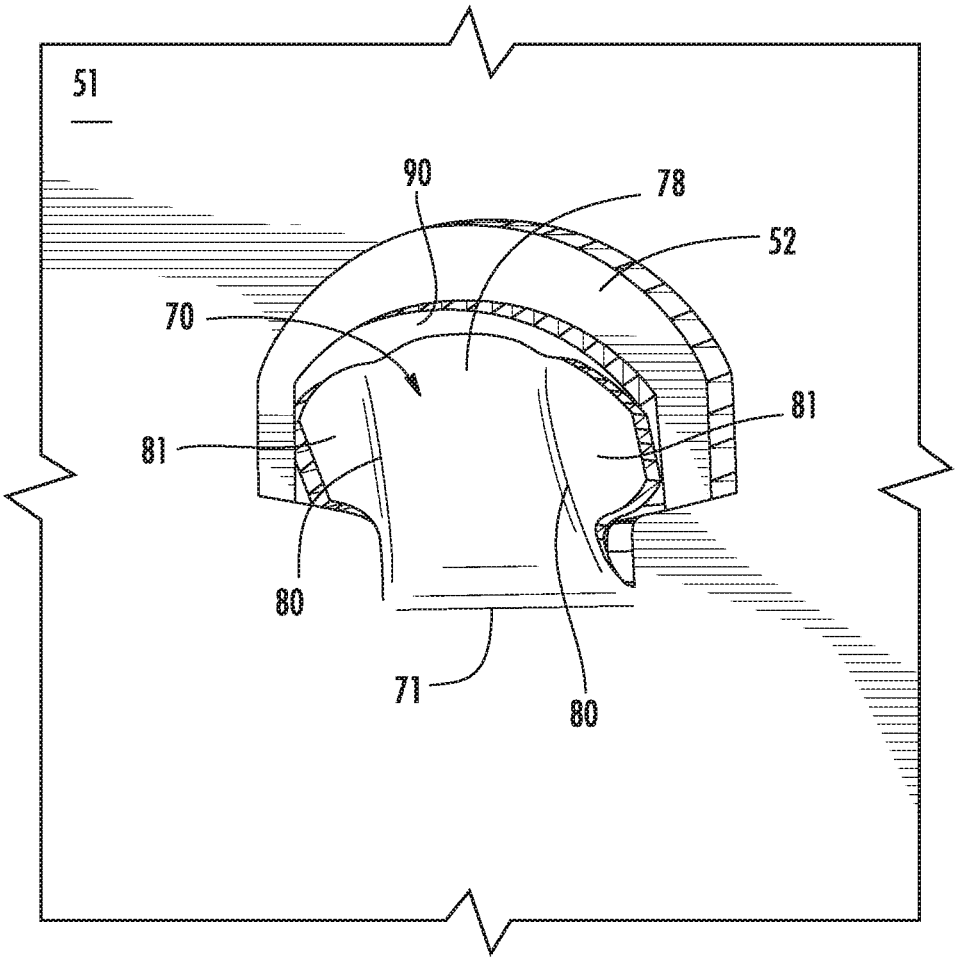
FIG. 12 is like FIG. 10, except for depicting an inner fastener assembly in the process of being fastened by moving the inner latching tab through an inner keeping hole of an inner flap.
Figure 13:
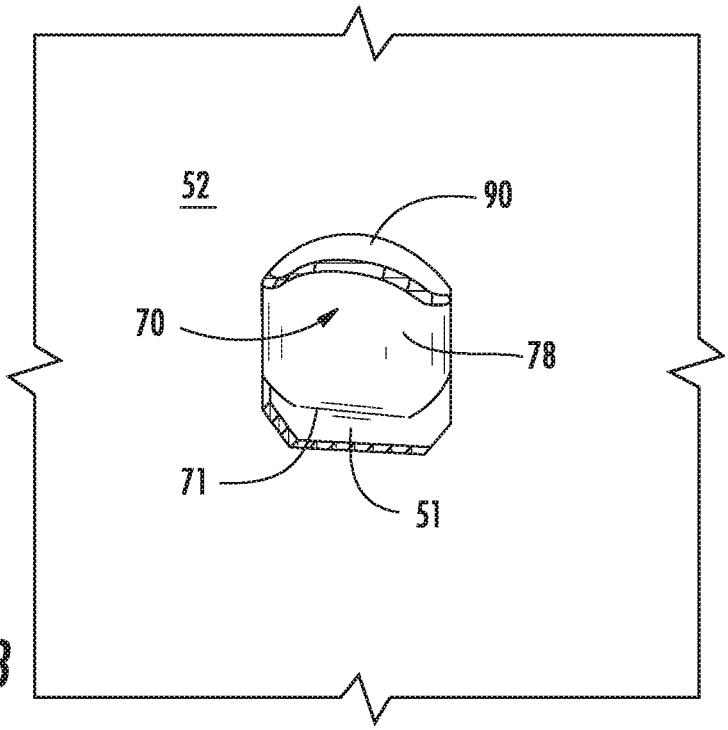
Figure 14:
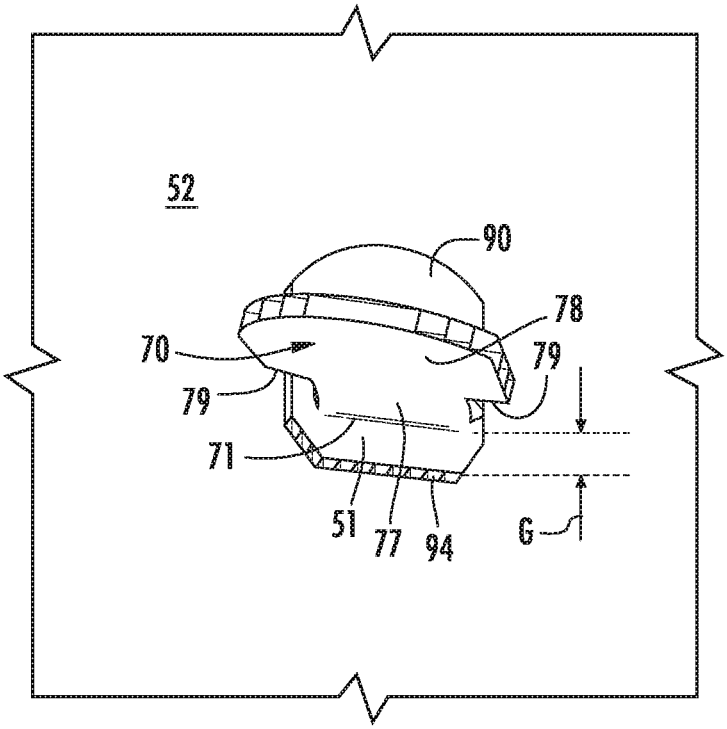
FIG. 14 is like FIG. 13, except for depicting the inner fastener assembly in one of its fastened configurations, in which the inner latching tab extends through and is mated with the inner keeping hole.

Referring to the representative exterior portion of the box 22 depicted in FIG. 12, and the representative interior portion of the box 22 depicted in FIG. 13, each inner latching tab head 78 can elastically deform as it is passed (e.g., pushed inwardly) through the respective inner keeping hole 90, comprising the head flaps 81 pivoting relative to a central portion of the inner latching tab head by way of folding along the crosswise fold lines 80. After the inner latching tab head 78 passes through the inner keeping hole 90, the inner latching tab head 78 can elastically return to its original shape (e.g., substantially return to its original shape) as depicted in FIG. 14. Both the elastic deforming and undeforming of the inner latching tab head 78 can comprise the head flaps 81 (FIGS. 2, 10 and 12) pivoting about the crosswise fold lines 80 relative to a central portion of the inner latching tab head 78.

In the embodiment depicted in FIG. 14, the inner latching tab 70 is secured in the inner keeping hole 90 to fasten an inner locking or fastener assembly 70, 90 that is configured to releasably secure (e.g., further secure) the respective flaps in their inwardly closed configuration. That is, each inner fastener assembly 70, 90 can include an inner latching tab 70 extending through and mated with a respective inner keeping hole 90. Regarding the representative, fastened or locked inner fastener assembly 70, 90 of the embodiment depicted in FIG. 14, the neck 77 extends through the inner keeping hole 90 so that the head's one or more outwardly extending engagement edges 79 engage the interior surface of the inner flap 52 so that each inner fastener assembly is secure enough to remain closed during typical usage of the box 22. However, each inner fastener assembly 70, 90 is typically also releasable or openable, by reversing the process of fastening the fastener assembly, or the like. The embodiment of FIG. 14 depicts a representative inner fastener assembly 70, 90 in a first example of its different fastened configurations, as will be discussed in greater detail below. Alternatively and as will also be discussed in greater detail below, for each of the inner fastener assemblies 70, 90, the positions of the inner latching tab 70 and corresponding inner keeping hole 90 can be interchanged, so that, for fastening, the inner latching tabs 70 are manually pulled through the respective inner keeping holes 90.

Figure 15:
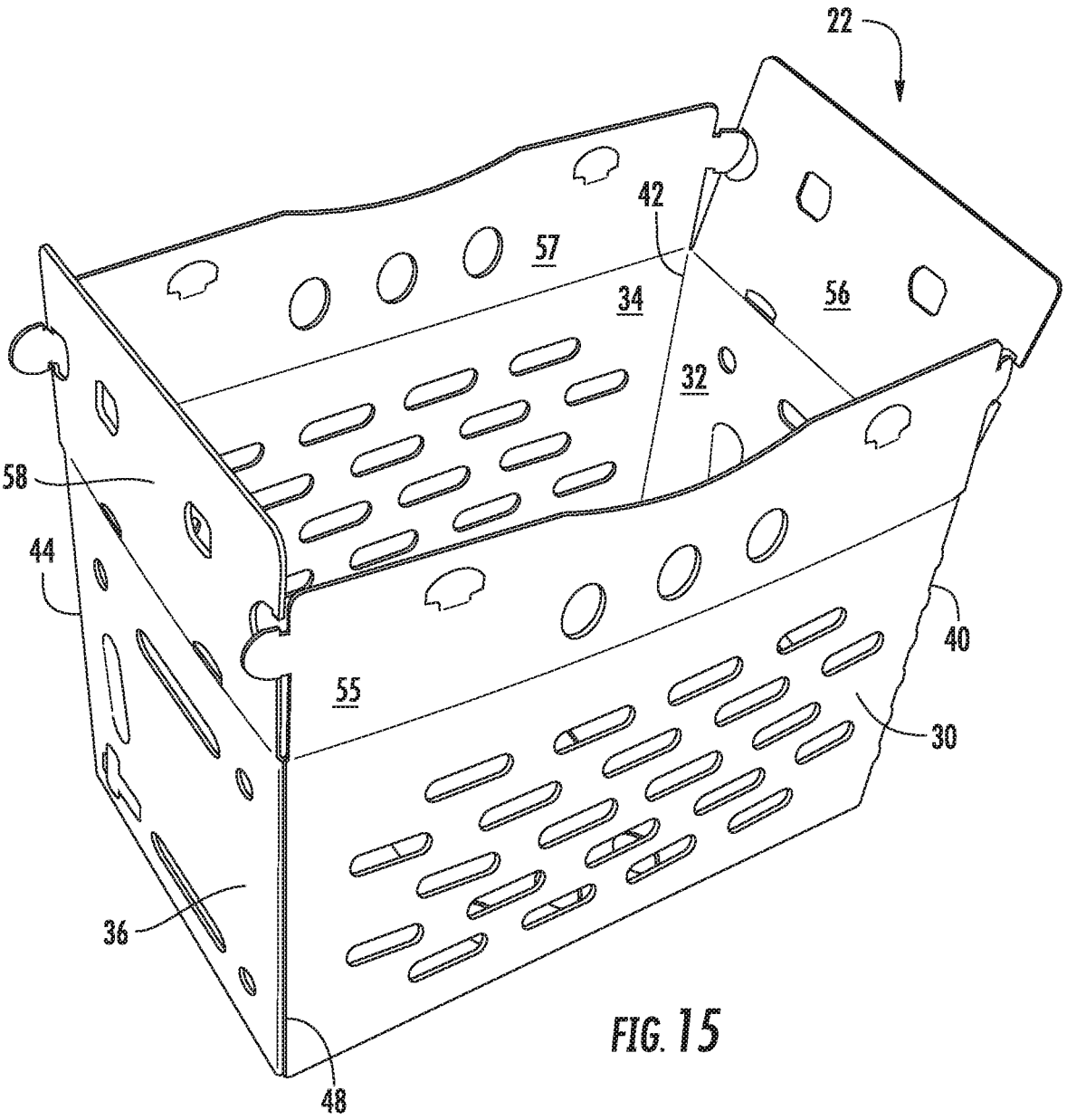
FIG. 15 is a top pictorial view of the box of the first embodiment with its upper end open and its lower end fastened closed.

An example of a method of using the box 22 is described in the following, in accordance with the first embodiment. The flaps 51-54 at an end of the box 22 can be fastened closed by the respective inner and outer fastener assemblies 85, 96, 70, 90, as discussed above; and an opposite, open end of the box can be oriented upwardly, as shown in FIG. 15, so that the fastened closed flaps 51-54 form a closed lower end of the box. In the embodiment of FIG. 15, the crosswise fold lines 40, 42, 44, 48, which respectively foldably connect the panels 30, 32, 34, 36, extend upright; and the lengths of the elongate flutes 130 (FIG. 4) in the panels 30, 32, 34, 36 extend crosswise to the crosswise fold lines 40, 42, 44, 48 (e.g., the flutes 130 in the panels 30, 32, 34, 36 extend horizontally).

Figure 16:
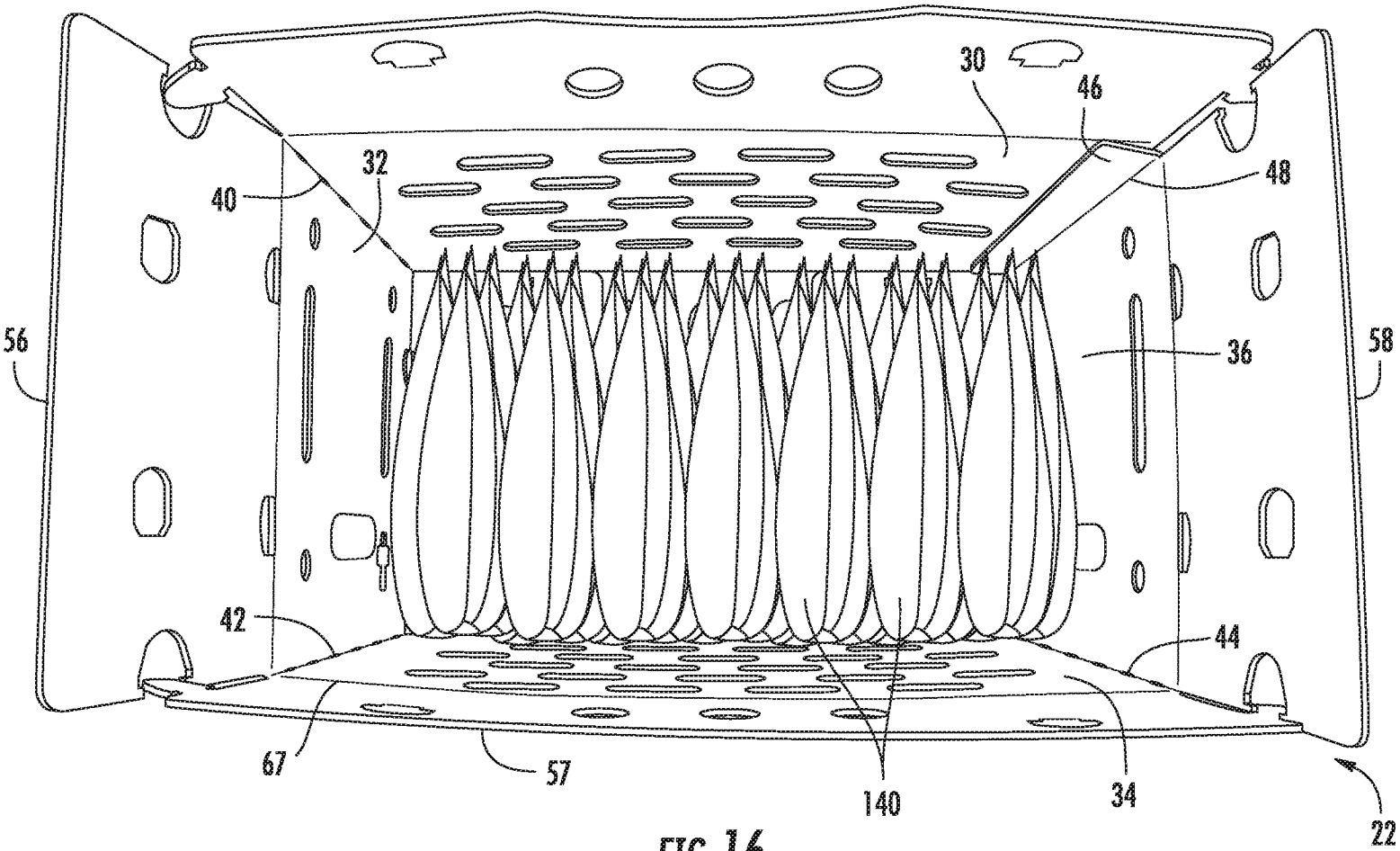
FIG. 16 is generally like FIG. 15, except that the box has been partially filled with ears of corn.

Referring to FIG. 16, a plurality of articles 140 can be placed into the interior of the upwardly open box 22 so that the articles are supported by the fastened closed, lower end of the box. In the example depicted in FIG. 16, the lengths of the articles 140 extend crosswise to the crosswise fold lines 40, 42, 44, 48, and opposite ends of at least some of the articles are simultaneously respectively engaged against the opposite side panels 30, 34. In the first embodiment, as depicted in FIGS. 16, 17 and 20-22, the articles 140 are ears of corn. However, the articles 140 can be other suitable types of articles, for example fresh agricultural products such as celery, broccoli, cabbage and any other suitable fresh vegetables, or the like. As will be discussed in greater detail below, the elongate articles 140 and/or elongate flutes 130 (FIG. 4) of the material that forms the boxes 22 can be oriented in a manner that seeks to improve, for example, the stacking strength of the boxes.

Ears of corn (e.g., articles 140) can be conveniently packed in the boxes 22 at packing locations that are typically used by the growers, for example in the fields where the corn is grown and at a packing facilities. In this regard, the boxes 22 are typically configured in a manner that seeks to allow the boxes to be easily manually erected. For example, the boxes 22 may be delivered to packing locations in the form of collapsed boxes 22 (FIG. 5) (e.g., folded-flat sleeves with open opposite ends). Then, the collapsed boxes 22 can be manually erected and closed. Alternatively, the boxes 22 can be at least partially erected and/or closed through the use of automated machinery.

Figure 17:
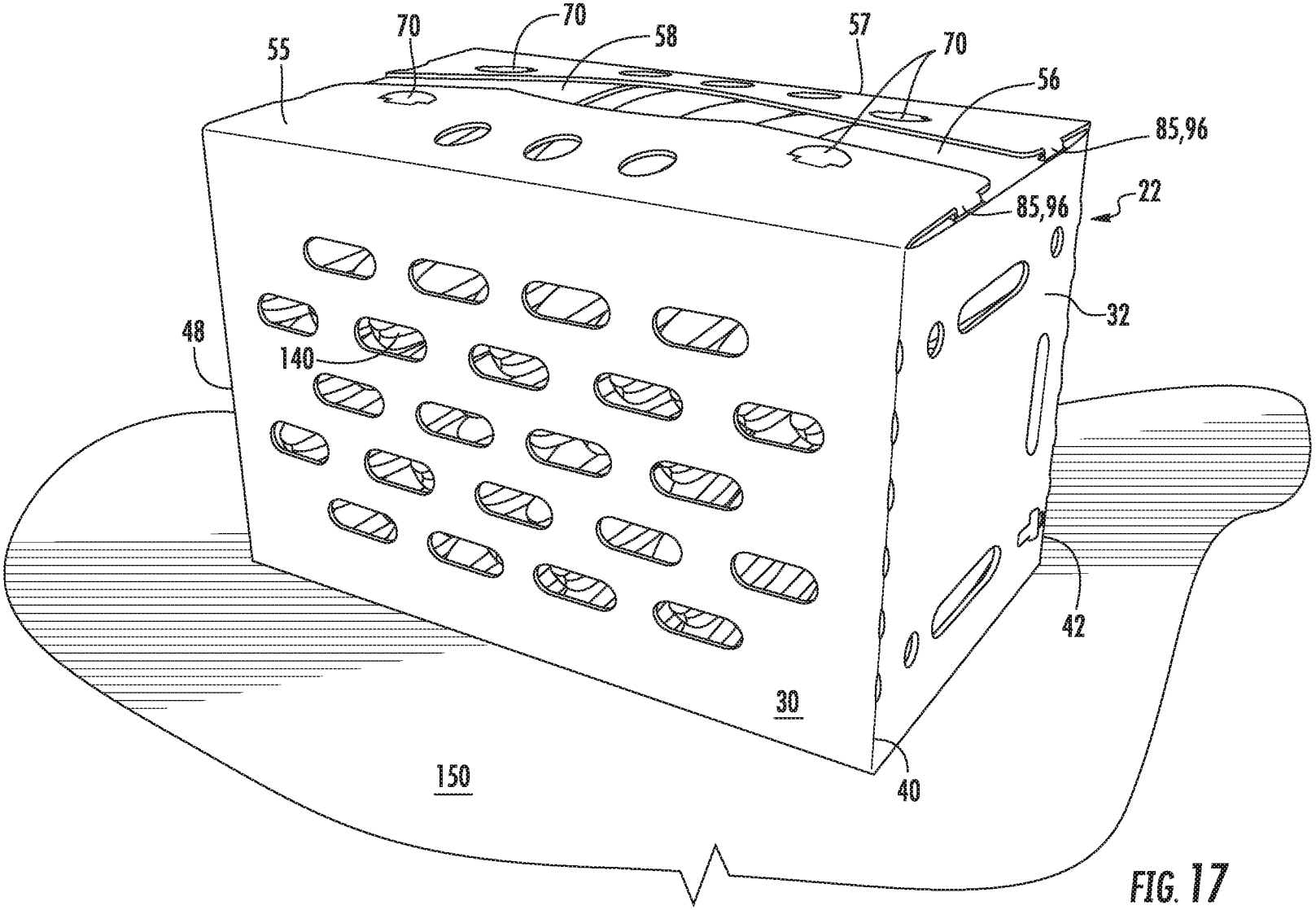
FIG. 17 depicts the closed box of the first embodiment filled (e.g., overfilled) with ears of corn, wherein the box together with its contents may be referred to as a package.

Referring to FIG. 17, after the box contains one or more of the articles 140, for example numerous of the articles, the flaps 55-58 at the upper end of the box 22 can be fastened closed, for example by the respective inner and outer fastener assemblies 85, 96, 70, 90, as discussed above. The fastened closed flaps 55-58 form a closed upper end of the box. In the example depicted in FIG. 17, the interior of the box 22 is depicted as being overfilled with the articles 140 so that the closed upper end of the box bulges outwardly (e.g., upwardly); and the outer fastener assemblies 85, 96 at the upper end of the box are depicted as being fastened, whereas the inner fastener assemblies 70, 90 (also see FIG. 18) are depicted as not yet being fastened.

Figure 18:
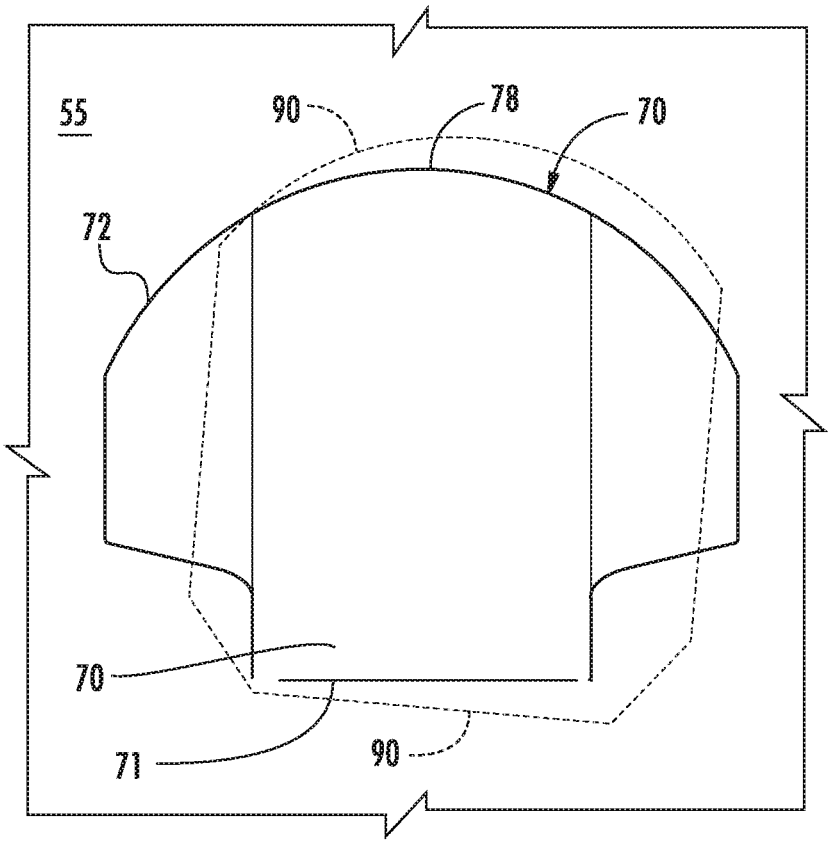
FIG. 18 is generally like FIG. 11, except for schematically depicting a different configuration of an un-struck inner latching tab at least partially superposed with a respective inner keeping hole in an outwardly bulging, closed end of the box of the first embodiment.

For each unstruck inner latching tab 70 in the outwardly bulging, upper closed end of the example of the box 22 depicted in FIG. 17, the inner latching tab 70 is at least partially superposed with a respective inner keeping hole 90, for example as schematically shown in FIG. 18. In FIG. 18, the representative inner keeping hole 90 is hidden from view beneath the outer flap 55; therefore, the inner keeping hole is schematically depicted with dashed lines. The inner latching tab 70 can simultaneously be at least partially superposed with, and also eccentrically arranged with respect to, the respective inner keeping hole 90, as schematically shown in FIG. 18.

Figure 19:
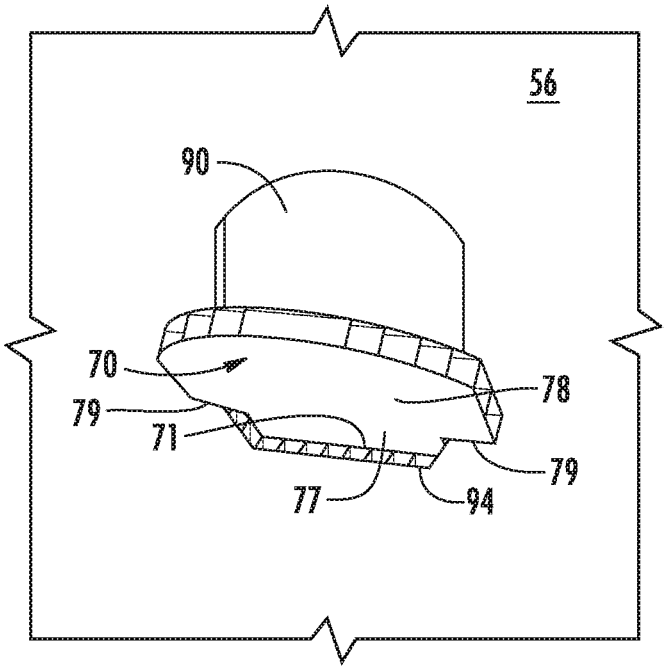
FIG. 19 is like FIG. 14, except that the fastened inner fastener assemblies of FIGS. 19 and 14 are in different fastened configurations, in accordance with the first embodiment.

Referring to FIGS. 18 and 19, the inner latching tab head 78 can be moved (e.g., pushed inwardly through) through the inner keeping hole 90 substantially as described above, to achieve the fastened configuration of the inner fastener assembly 70, 90, which is depicted in FIG. 19. For example, in the first embodiment, the inner keeping hole 90 is configured (e.g., is elongate) to allow the inner fastener assembly 70, 90 to be fastened when the box is bulging due to being overfilled or filled with large season corn, or the like.

In accordance with the first embodiment, as best understood by comparing and contrasting FIGS. 8, 11, 17 and 18, each pair of overlapping inner flaps 52, 54, 56, 58 and outer flaps 51, 53, 55, 57 is configured to be in a plurality of different, predetermined overlapping configurations with one another. In a first example of an overlapping configuration with reference to FIGS. 8, 11 and 14, each of the flaps 51, 52 can be planar (e.g., about planar and, thus, not bulging), and the flaps 51, 52 can extend parallel (e.g., about parallel) to one another. In a second, contrasting example of an overlapping configuration with reverence to FIGS. 17-19, each of the flaps 55, 56 can be similarly arcuately deformed (e.g., bulging outwardly). In this regard, the contrast between FIGS. 11 and 18 demonstrates that, for each pair of respectively overlapping inner and outer flaps 51, 52, 53, 54, 55, 56, 57, 58, relative movement occurs between the pair of flaps in response to transitioning between the first and second examples of the overlapping configuration.

Referring to FIGS. 14 and 19, the inner fastener assemblies 70, 90 can transition between predetermined fastened configurations in response to predetermined relative movement between overlapping pairs of inner and outer flaps 51, 52, 53, 54, 55, 56, 57, 58. Accordingly, each inner fastener assembly 70, 90 can be referred to as a variable fastener assembly. The variable fastener assemblies 70, 90 of the first embodiment are configured to transition between a plurality of predetermined fastened configurations for respectively releasably securing the respective inner and outer flaps 51, 52, 53, 54, 55, 56, 57, 58 to one another. In this regard, FIG. 14 depicts a variable fastener assembly 70, 90 in a first fastened configuration, and FIG. 19 depicts a variable fastener assembly 70, 90 in a second fastened configuration. In the first embodiment, for each variable fastener assembly 70, 90, the variable fastener assembly is in the first fastened configuration (FIG. 14) when its respective flaps 51, 52, 53, 54, 55, 56, 57, 58 are planar (e.g., about planar and, thus, not bulging) and extend parallel (e.g., about parallel) to one another; and the variable fastener assembly is in the second fastened configuration (FIG. 19) when its respective flaps are similarly arcuately deformed (e.g., bulging inwardly or outwardly) to a predetermined extent.

In the example of the first fastened configuration of the variable fastener assembly 70, 90 depicted in FIG. 14, the neck 77 is positioned in and extends through a first portion of the inner keeping hole 90 so that the head's one or more outwardly extending engagement edges 79 engage the interior surface of the inner flap 52 so that each inner fastener assembly is typically secure enough to remain closed during typical usage of the box 22. In FIG. 14, the first portion of the inner keeping hole 90 is distant from each of the opposite ends of the inner keeping hole so that a gap G is defined between the longitudinal fold line 71 (which is located at the end of the neck 77) and the respective end of the keeping hole, wherein the respective end can be the tapered end of the keeping hole, or more specifically the end defined by the crosswise edge 94. For example, the gap G in the configuration of FIG. 14 can be about 5 mm. More generally, the gap G in the configuration of FIG. 14 can be at least about 2 mm, in a range of from about 2 mm to about 10 mm, at least about 3 mm, in a range of from about 3 mm to about 8 mm, at least about 4 mm, or in a range of from about 4 mm to about 7 mm, including all values and subranges therebetween for each of the above.

Each of the variable fastener assemblies 70, 90 can transition from the first fastened configuration depicted in FIG. 14 to the second fastened configuration depicted in FIG. 19 in response to the flaps associated with the variable fastener assembly transitioning from the first overlapping configuration (e.g., planar and parallel) to the second overlapping configuration (e.g., bulging). The transitioning from the first fastened configuration depicted in FIG. 14 to the second fastened configuration depicted in FIG. 19 can include relative movement between the inner latching tab 70 and the inner keeping hole 90 along a length dimension of the inner keeping hole 90 so that the neck 77 moves from the first portion of the inner keeping hole (e.g., as shown in FIG. 14) to a second portion of the inner keeping hole (e.g., as shown in FIG. 19). For the embodiment depicted in the drawings, the second portion of the inner keeping hole 90 that is containing the latching tab 70 in FIG. 19 is closer to the crosswise edge 94 (e.g., the tapered end) of the keeping hole as compared to the first portion of the inner keeping hole that is containing the latching tab 70 in FIG. 14. For the embodiment depicted in the drawings, a width dimension of the second portion of the inner keeping hole 90 that is containing the latching tab 70 in FIG. 19 is smaller than a width dimension of the first portion of the inner keeping hole that is containing the latching tab 70 in FIG. 14, so that an area of contact between the latching tab 70 (e.g., one or more of the engagement edges 79) and the second flap that defines the keeping hole is greater, and the strength of the variable latch assembly 70, 90 can be greater, in the configuration of FIG. 19 as compared to the configuration of FIG. 14.

Figure 20:
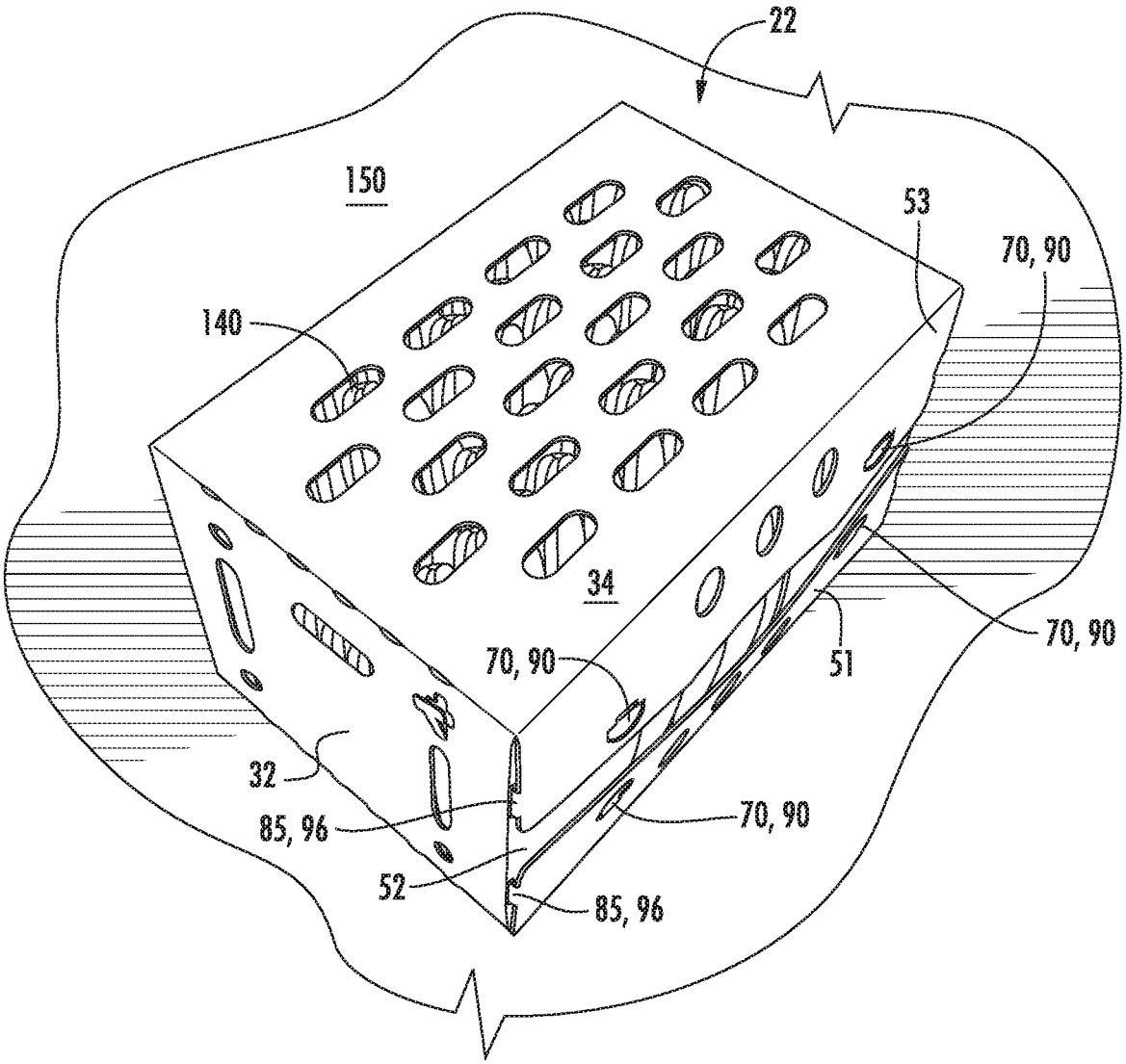
FIG. 20 is like FIG. 17, except, for example, that the box has been turned on its side, so that the ears of corn are upright, in accordance with the first embodiment.

In an example of a method of using the box 22, the box 22 may be filled and closed as shown in FIGS. 16 and 17, all of the fastener assemblies 85, 96, 70, 90 can be fastened closed, and the bottom side of the box can be upon a supporting surface 150 (FIG. 17) so that the lengths of the elongate flutes 130 (FIG. 4) in the panels 30, 32, 34, 36 and the lengths of the articles 140 extend crosswise to the upright fold lines 40, 42, 44, 48. Then, the box 22 can be turned on its side (e.g., rotated) so that the box is configured as depicted in FIG. 20. When the box 22 is turned on its side, the articles 140 in the box may move slightly or shift positions in a manner that seeks to cause the sides formed by the flaps 51-58 to bulge outwardly. In this regard, the fastener assemblies 70, 90 seek to prevent and/or at least restrict such bulging, and seek to allow the box to contain variable sizes of ears of corn that may overfill the box, while the releasable fastener assemblies 70, 90 seek to remain securely fastened until intentionally being manually unfastened. The fastener assemblies 70, 90 can be cooperatively configured in a manner that seeks to restrict bulging associated with overfilling of the box 22. The box 22 with its contents (e.g., articles 140 contained by the box) may be referred to as a package. For example, the package can be turned on its side (e.g., rotated) so that the package is configured as depicted in FIG. 20.

In the first embodiment, when the variable fastener assemblies 70, 90 are fastened to at least partially secure the flaps 51-58 in closed, non-bulging configurations, any predetermined bulging of the flaps thereafter can cause the respective variable fastener assemblies 70, 90 to transition from the fastened configuration shown in FIG. 14 to the fastened configuration shown in FIG. 19, or the like, so that the dimension or size of the gap G (FIG. 14) between the longitudinal fold line 71 (which is located at the end of the neck 77) and the crosswise edge 94 (which defines an end of the keeping hole 90) becomes reduced, for example by being reduced to about zero, or near zero, or the like. For example, in response to predetermined relative movement between (e.g., outward bulging of) an overlapping pair of the flaps 51-58, there can be relative sliding engagement between one or more of the outwardly extending edges 79 of an associated inner latching tab 70 and the one or more respective surfaces of the flap defining the inner keeper hole 90 mated with the inner latching tab so that the sliding engagement occurs along a lengthwise dimension of the inner keeper hole.

In the configuration depicted in FIG. 20: the first panel 30 is the bottom panel 30; the second panel 32 is a side panel 32; the third panel 34 is the top panel 34; the fourth panel 36 is another side panel 36; the lengths of the elongate flutes 130 (FIG. 4) extend upright in each of the side panels 32, 36 and inner flaps 52, 54, 56, 58; and opposite ends of at least some of the articles 140 (e.g., ears of corn) are simultaneously respectively engaged against the opposite bottom and top panels 30, 34.

Figure 21:
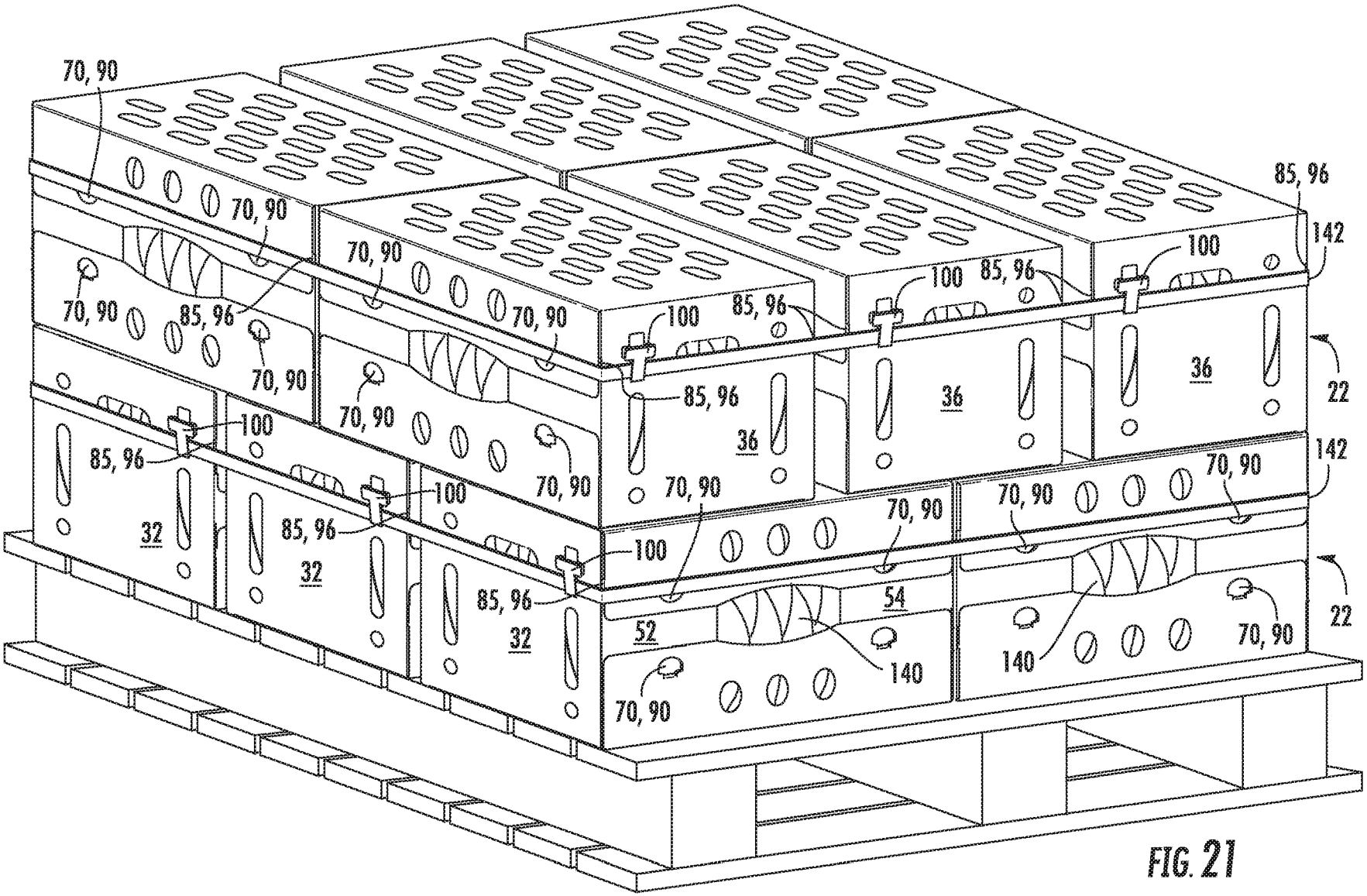
FIG. 21 depicts several boxes of the first embodiment that are configured like in FIG. 20 and stacked on a pallet, in accordance with an example of the first embodiment.

Referring to FIG. 21, one or more of the boxes 22 configured as in FIG. 20 can be stacked upon one another so that the weight of an upper box 22 (e.g., object) that is sitting upon the top panel 34 of a lower box 22 is at least partially supported by the side panels 32, 36, inner flaps 52, 54, 56, 58, and at least some of the articles 140 in the lower box 22, so that at least some articles 140 in the lower box experience lengthwise compression in response to bearing at least some of the weight of the upper box 22. At least partially reiterating from above, the corrugations or flutes 130 (FIG. 4) in the material of the boxes 22 and at least some of the articles 140 in the boxes can be oriented in a manner that seeks to improve the stacking strength of the boxes.

Figure 22:
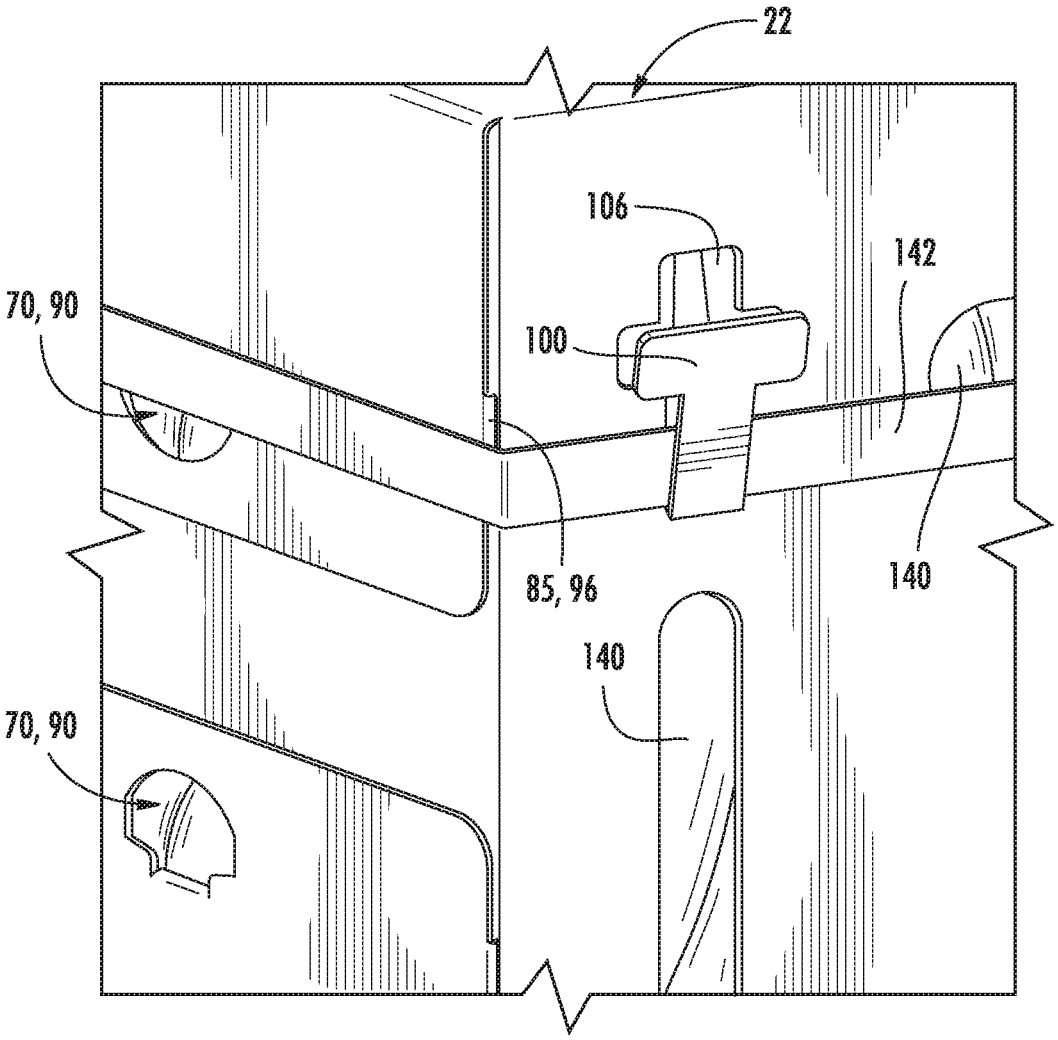
FIG. 22 is an enlarged view of a portion of FIG. 21.

Referring to FIGS. 21 and 22, in one or more layers of the stacked boxes 22, one or more of the support tabs 100 can be pivoted outwardly, comprising striking the support tabs 100 from the outer side panels 32, 36 and folding along the crosswise fold lines 102. The outwardly pivoted support tabs 100 can extend obliquely upwardly (e.g., at an angle of about 45 degrees relative to vertical) so as to at least partially support at least one strap 152 extending around one or more of the boxes 22. The support tabs 100 of the first embodiment are configured to help packers strap pallet loads. The support tabs 100 can be configured to hold the strap 152 in a level position as the strap is wrapped around multiple boxes 22 in a pallet layer. The support tabs 100 can also be configured in a manner that seeks to align the strap 152 directly over (e.g., substantially over) the respective fastener assemblies 85, 96, 70, 90 to provide additional support in a manner that seeks to keep the flaps 51-58 closed. In an erected box 22, the support tabs 100 can be aligned (approximately or substantially aligned) with respective fastener assembly parts 85, 96, 70, 90 in a manner that seeks to allow the support tab to align a strap 152 over the respective fastener assemblies 85, 96, 70, 90 in a manner that seeks to keep the respective fastener assemblies 85, 96, 70, 90 and flaps 51-58 closed.

In the first embodiment, the boxes 22 include features (ventilation or drainage holes 120, 122, 124) that seek to provide improved performance in cooling processes, for example hydro-cooling processes. For example, boxes 22 can be waterproof and configured to provide fast chilling times for their content. The venting and/or drainage holes 120, 122, 124 can be positioned in the panels and flaps of the box 22 in a manner that seeks to improve chilling time, improve water flow from the top side of the box and improve drainage capability throughout the bottom and other sides of the box. For example, the venting and/or drainage holes 120, 122, 124 can be in the form of elongate, or more specifically oval, holes that seek to enhance the water flow into and out of the box 22 when hydro-cooling is used to remove field heat from corn. In addition and/or alternatively, the ventilation holes 120, 122, 124 can seek to provide improved performance in air-based cooling processes, for example vacuum cooling processes for celery or other suitable vegetables.

At least partially reiterating from above in accordance with an example of a method of using the boxes 22, lengthwise axes of ears of corn (or other suitable articles 140) in the boxes can extend upright (e.g., substantially vertical) when the ears of corn are being chilled and transported. More specifically, after the ears of corn are loaded into each box 22 so that the lengthwise axes of the ears of corn extend substantially horizontally, the box can be turned 90 degrees after the box is full and fastened closed, so that the lengthwise axes of the ears of corn become oriented substantially vertically. In this "turned on the side configuration" in which the lengthwise axes of the ears of corn are oriented substantially vertically, numerous of the corrugated plastic flutes of the box can also extend substantially vertically, in a manner that seeks to provide improved strength (resistance to vertical crushing), and ears of corn in the box can also bear some of any vertical load on the box. For example, uprightly extending articles 140 (e.g., ears of corn) in the boxes 22 can help to support stacking loads. The handle holes 110, 112 of the first embodiment box 22 can be located and oriented to provide an easy way to carry the box and also to indicate the stacking orientation of the box.

As an example regarding the lengthwise axes of the ears of corn being oriented substantially vertically (e.g., "stacked vertically"), hydro-cooling may be most effective when the vegetables are stacked vertically. Such vertical stacking typically allows for free flowing water to cool the product. Accordingly, stacking vegetables in a vertical arrangement may be desirable. In many situations, initially packaging vegetables into boxes vertically is very time consuming such that it is not economically viable. In contrast and at least partially reiterating from above, the box 22 may be filled and closed as shown in FIGS. 16 and 17, so that the lengths of the articles 140 extend substantially horizontally. Then, the box 22 can be turned on its side (e.g., rotated) so that the box is configured as depicted in FIG. 20. When the box 22 is turned on its side, (e.g., rotated) the box and its contents are configured as depicted in FIG. 20, wherein the contents are oriented substantially vertically. As a more general example, the box 22 can be filled with articles 140 (e.g., vegetables) so that the vegetables extend substantially horizontally for fast and convenient box loading, then the loaded and closed box can be turned on its side to provide the benefit of vertical orientation of the articles, and then hydro-cooling can be performed. In addition and/or alternatively to the provision of stacking strength, when a box 22 is constructed of polypropylene, corrugated polypropylene, or another suitably tough material, the latched fastener assemblies 85, 96, 70, 90 seek to provide strong connections for holding the vegetable-laden box in a substantially rectangular shape, so as to maintain the substantially vertical orientation of the vegetables in the box. The substantially vertical orientation of the vegetables can enhance the effectiveness of, for example, hydrocooling and/or other cooling processes.

In accordance with the first embodiment, the stacking strength of the boxes 22 (which can be at least partially provided by the articles 140 in the boxes) and strength of the corrugated and/or fluted polymeric sheet from which the blanks 20 and boxes 22 are formed can be cooperatively configured in a manner that is believed to provide a new balance of properties. For example, the corrugated or fluted polymeric sheet material from which the blanks 20 and boxes 22 can be formed may have a predetermined thickness and density, wherein the density can be expressed by the weight per area of the sheet material in grams per square meter ("GSM"). In the first embodiment: the capacity of the box 22 can be 40 pounds (e.g., about 40 pounds); the weight of the empty box can be 588 grams (e.g., about 588 grams); the interior dimensions of the box can be 29.0 cm by 48.3 cm by 29.1 cm (e.g., about 29.0 cm by about 48.3 cm by about 29.1 cm); the exterior dimensions of the box can be 29.9 cm by 49.5 cm by 30.5 cm (e.g., about 29.9 cm by about 49.5 cm by 30.5 about cm); the thickness of the sheet material that the blank 20 and box comprise, consist essentially of, or consist of can be 3.5 mm (e.g., about 3.5 mm); the density of the uncut portions of the sheet material that the blank and box comprise, consist essentially of, or consist of can be 720 GSM (e.g., about 720 GSM); the area of the flat blank 20 can be 61.4 cm by 164.2 cm (e.g., about 61.4 cm by 164.2 cm); and the scrap removed from the sheet material of the blank can be 25.2% (e.g., about 25.2%). As examples, it is believed that each of the values presented in this paragraph can vary by plus or minus about 25 percent, by plus or minus about 18 percent, by plus or minus 10 percent, or by plus or minus about 5 percent, including all values and subranges therebetween for each of the above.

In accordance with the first embodiment, the boxes 22 can be formed of the above-described corrugated and/or fluted polymeric sheet material that seeks to function well in a variety of situations, for example when the boxes include stacking tabs (not shown) for facilitating staking of the boxes in columns on a pallet, and as another example when the boxes may not include stacking tabs and the boxes are stacked in a crosswise stacking configuration on a pallet. After boxes 22 are emptied of their contents (e.g., articles 140), the boxes can be collapsed or "knocked down flat" so that they are configured as shown in FIG. 5, and then the collapsed boxes can be reused, recycled and/or the like.

Figure 23:
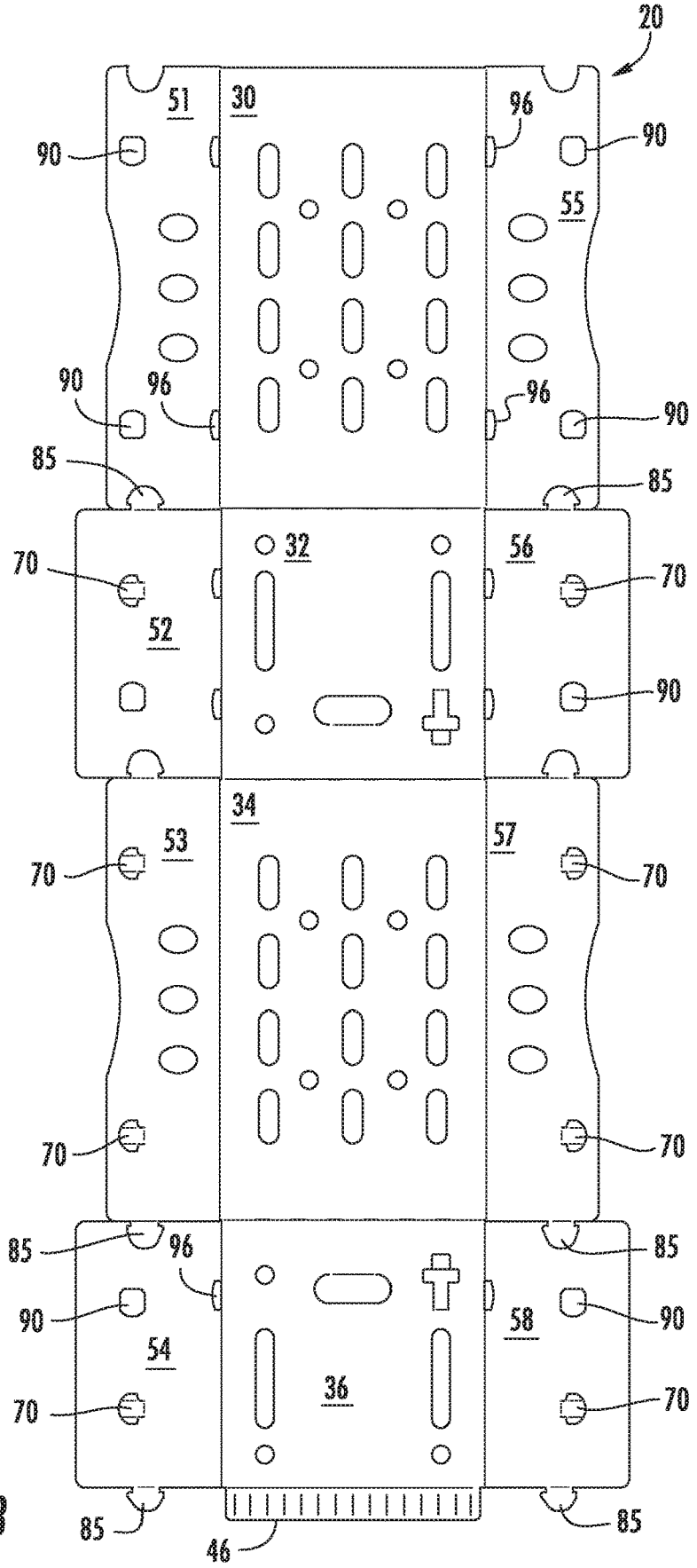
FIG. 23 is a plan view of a flat, unfolded blank that is configured to be formed into a box, in accordance with a second embodiment of this disclosure.
Figure 24:
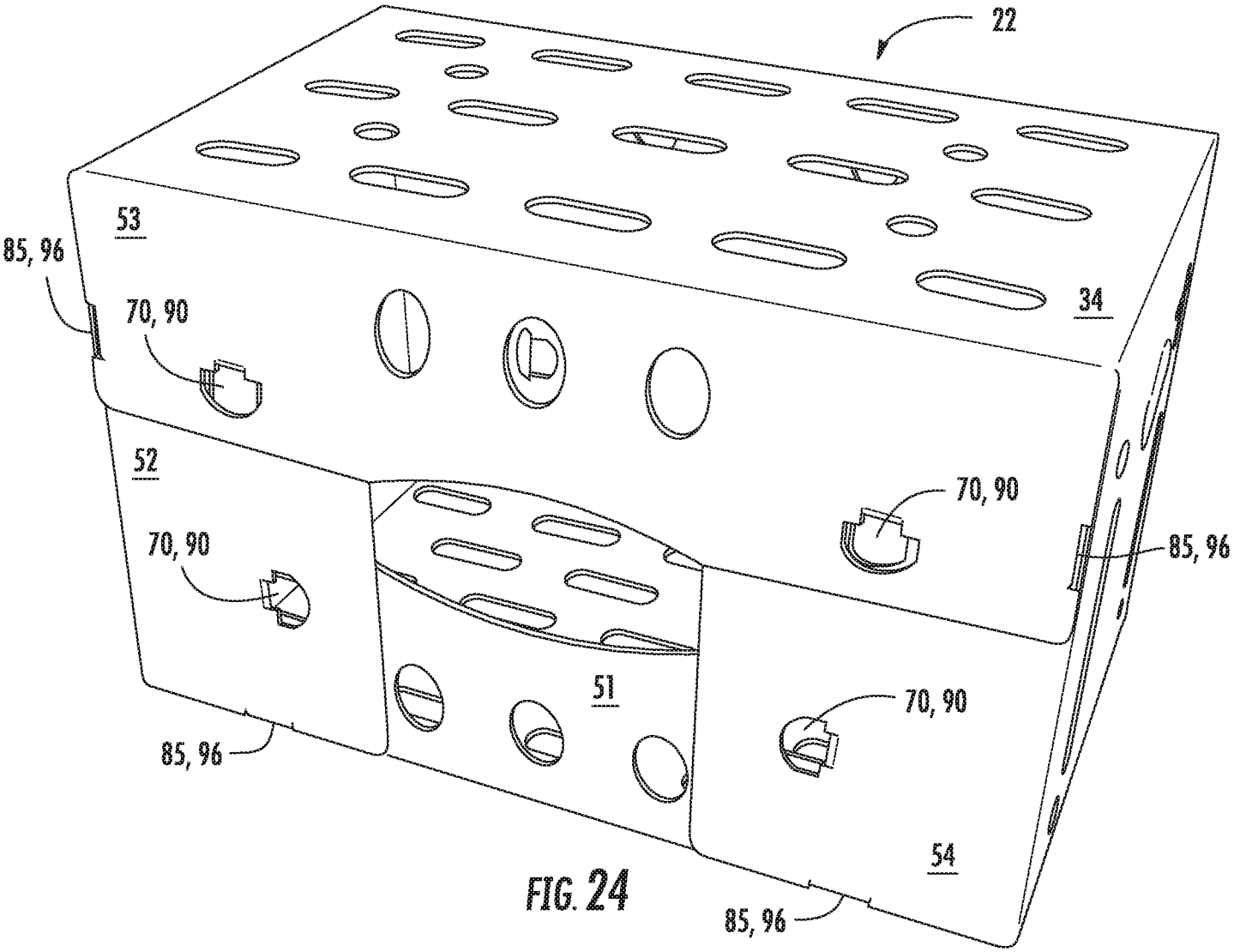
FIG. 24 depicts a closed box formed from the blank of FIG. 23.

A second embodiment of this disclosure is like the first embodiment, except for variations noted and variations that will be apparent to those of ordinary skill in the art. For example and referring to FIGS. 23 and 24, in the blank 20 and box 22 of the second embodiment, the fastener assemblies 85, 96, 70, 90 are arranged differently and the sequence of folding the flaps 51, 52, 53, 54, 55, 56, 57, 58 varies as compared to the first embodiment.

A third embodiment of this disclosure can be like the first and second embodiments, except for variations noted and variations that will be apparent to those of ordinary skill in the art. For example and as apparent from contrast between FIGS. 1, 23 and 25, in the third embodiment the outer latching tabs 285 (FIG. 25) and outer keeping holes 396 (FIG. 25) are configured differently as compared to the outer latching tabs 85 (FIGS. 23 and 25) and outer keeping holes 96 (FIGS. 23 and 25) of the first and second embodiments.

Figure 25:
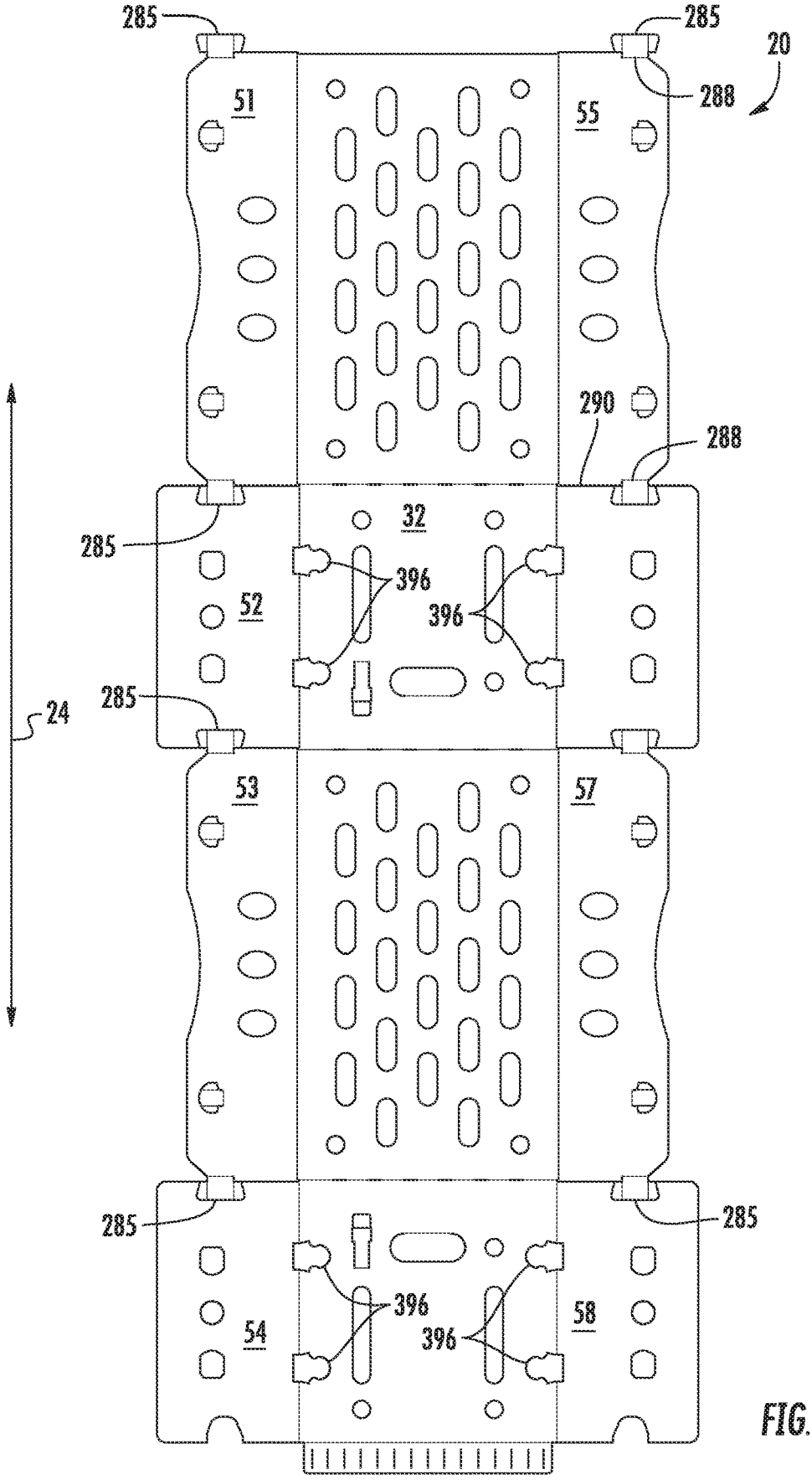
FIG. 25 is a plan view of a flat, unfolded blank that is configured to be formed into a box, in accordance with a third embodiment of this disclosure.

In the example of the third embodiment depicted in FIG. 25, each of the outer flaps 51, 53, 55, 57 can be the same, or generally or substantially the same, as compared to one another, except for their respective locations. Therefore, the following discussion of the fifth flap 55 is descriptive of each of the outer flaps. The fifth flap 55 can include, or have connected thereto for pivoting therewith, one or more latches that can be tabs, wherein these tabs may be referred to as outer latching tabs 285. The outer latching tabs 285 can be respectively connected to opposite portions of the fifth flap 55 by crosswise fold lines 288. The crosswise fold lines 288 can be inwardly recessed as compared to the opposite, outer crosswise peripheral edges 290 of the fifth flap 55.

Figure 26:
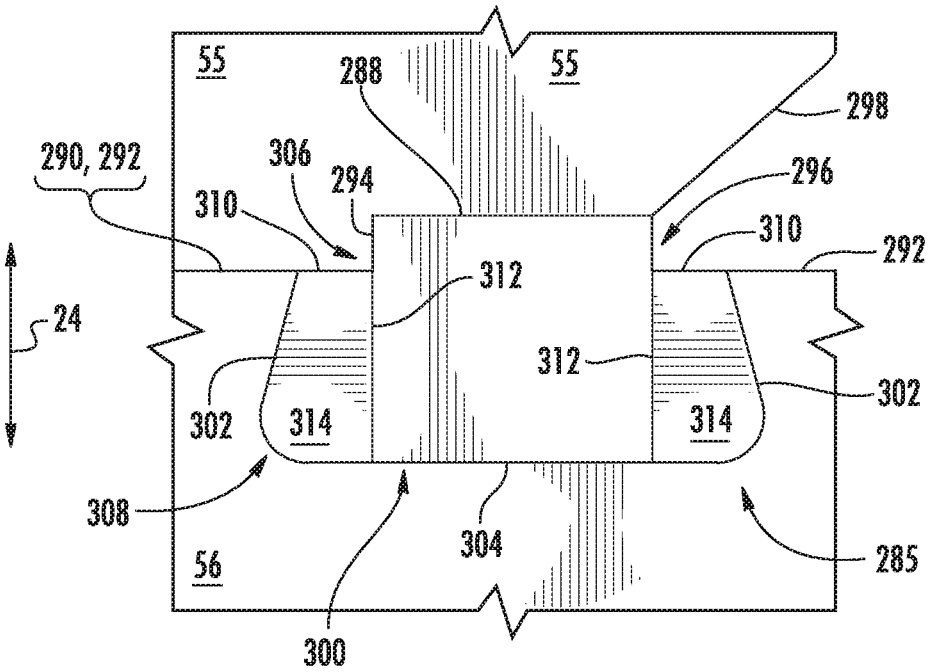
FIG. 26 is an enlarged, isolated view of a representative outer latching tab of the blank of FIG. 25.

Referring to FIG. 26, the representative outer latching tab 285 can be partially defined by the crosswise fold line 288 in the fifth flap 55. The crosswise fold line 288 can be recessed in the longitudinal direction 24 from the adjacent fifth flap crosswise edge 290. This longitudinal recess may be about 2.0 mm, at least about 2.0 mm, or in a range of from about 2.0 mm to about 5.0 mm, including all values and subranges therebetween for each of the above. Alternatively, differently configured recesses can be defined between crosswise fold line 288 and the adjacent fifth flap crosswise edge 290, or the crosswise fold line 288 may not be recessed relative to the adjacent fifth flap crosswise edge 290.

The representative outer latching tab 285 can be further partially defined by a longitudinal cut 294 (e.g., slit) extending through the fifth flap 55 from (e.g., from proximate) one end of the crosswise fold line 288 to (e.g., to proximate) the fifth flap crosswise edge 290. The representative outer latching tab 285 can be further partially defined by an at least partially longitudinal cut 296 (e.g., cutout) extending through the fifth flap 55 at least from (e.g., from proximate) one end of the crosswise fold line 288 to (e.g., to proximate) the crosswise edge 292 of the sixth flap 56. The cutout 296 can be somewhat triangular so that an outer edge 298 of the fifth flap 55 extends obliquely from (from proximate) an end of the crosswise fold line 288.

The representative outer latching tab 285 can be further partially defined by a generally or substantially U-shaped curved cut or slit 300 having oblique sections 302 and a crosswise section 304. The oblique sections 302 can extend from (e.g., from proximate) opposite ends of the crosswise section 304 to (e.g., to proximate) the sixth flap crosswise edge 292, so that the outer latching tab 285 has a neck 306 extending outwardly from (e.g., from proximate) the crosswise fold line 288 to (e.g., to proximate) a head 308 of the outer latching tab 285. The head 308 can be wider than the neck 306, so that the head includes one or more outwardly extending engagement edges 310 extending outwardly from the neck. The head 308 can include longitudinal fold lines 312 that are respectively approximately in line with, and extend from (e.g., extend from proximate), the longitudinal cuts 294, 296 to (e.g., to proximate) the crosswise slit section 304 to at least partially define opposite flaps 314 of the head 308.

Reference numerals 302, 304 can also designate respective edges of the head 308. Arcuate or convex edges of the head 308 can be respectively positioned between adjacent ends of the edges 302, 304 of the head 308. In the example depicted in FIG. 26, the head 308 extends in an outward direction (e.g., the longitudinal direction 24) away from the neck 306, and the head is tapered so that the opposite edges 302 of the head extend divergently with respect to one another in the outward direction. Accordingly, in the embodiment depicted in FIG. 26, the head 308 at least partially or substantially defines a trapezoidal shape, with the short side of the trapezoid adjacent the neck 306. This configuration seeks to ease the process of inserting the head 308 through the respective keeping hole 396, as will be discussed in greater in greater detail below.

Figure 27:
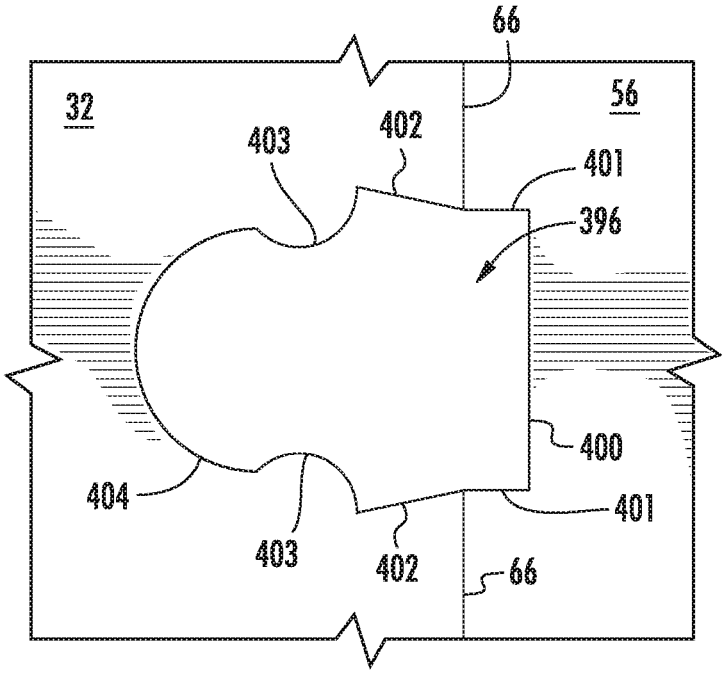
FIG. 27 is an enlarged, substantially isolated view of a representative outer keeping hole of the blank of FIG. 25, wherein the outer keeping hole of FIG. 27 is configured to receive the outer latching tab of FIG. 26 to form an outer fastener assembly.

Referring to FIG. 27, the representative outer keeping hole 396 can interrupt the longitudinal fold line 66 between the second panel 32 and the sixth flap 56, so that the outer keeping hole 396 is positioned between sections of the fold line 66. The outer keeping hole 396 can include, or be defined by, an annular series of inner edges 400-404 that extends around, and defines, the outer keeping hole. The inner edges 400-404 can include inner edges 400, 401 of the second panel 32, and inner edges 402-404 of the sixth flap 56. In the second panel 32, crosswise edges 401 can respectively extend from (e.g., from proximate) opposite ends of longitudinal edge 400 to (e.g., to proximate) the longitudinal fold line 66. In the sixth flap 56, oblique edges 402 can extend from (e.g., from proximate) ends of the crosswise edges 401, arcuate or convex edges 403 can extend from (e.g., from proximate) ends of the oblique edges 402, and opposite ends of arcuate or concave edge 404 can respectively extend from (e.g., from proximate) ends of the convex edges 403.

The convex edges 403 can be outer edges of respective protrusions of the second panel 32. Accordingly, reference numerals 403 can also be used to designate these protrusions 403. These protrusions 403 can extend into the outer keeping hole 396 and be configured to engage the respective outer latching tab 285, as will be discussed in greater detail below. There can be one or more of the protrusions 403 that are at least partially defined by the convex edge(s) 403 or other suitable features, and when there are two of such protrusions 403 they can be opposed (e.g., diametrically or substantially diametrically opposed) to one another.

Figure 28:
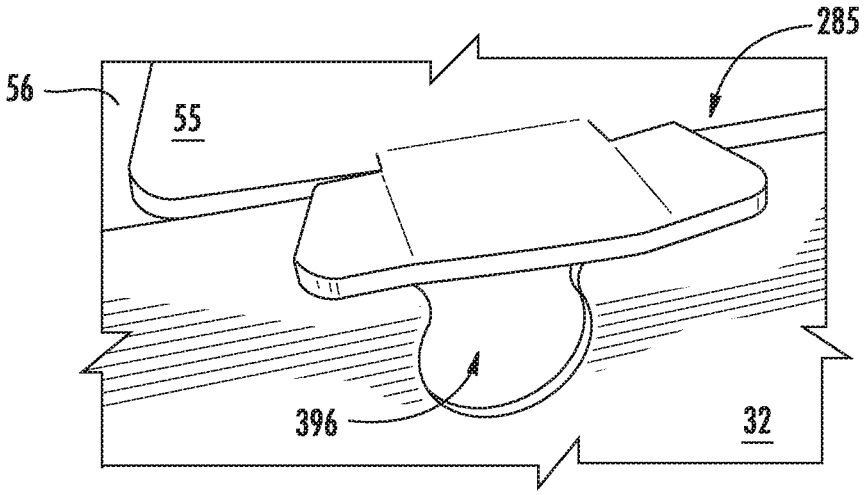
FIG. 28 depicts a portion of a closed end of a box erected from the blank of FIG. 25, wherein the outer fastener assembly is in an unfastened configuration.
Figure 29:
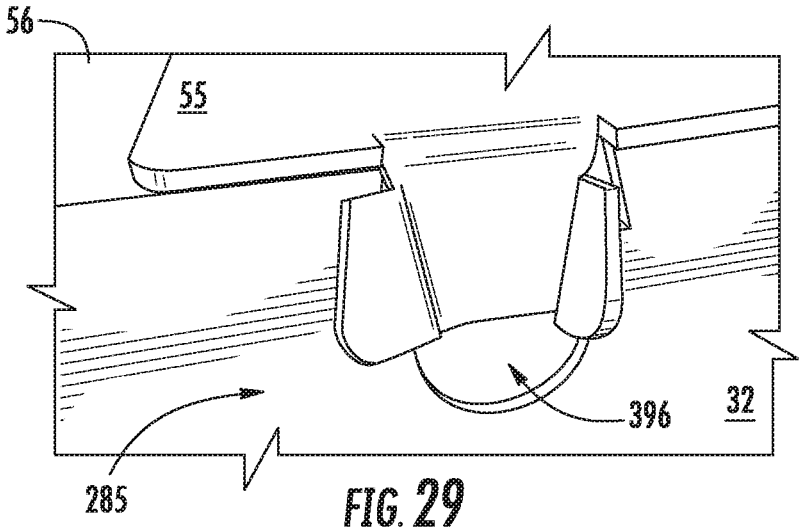
FIG. 29 is like FIG. 28, except for depicting the outer fastener assembly in the process of being fastened.
Figure 30:
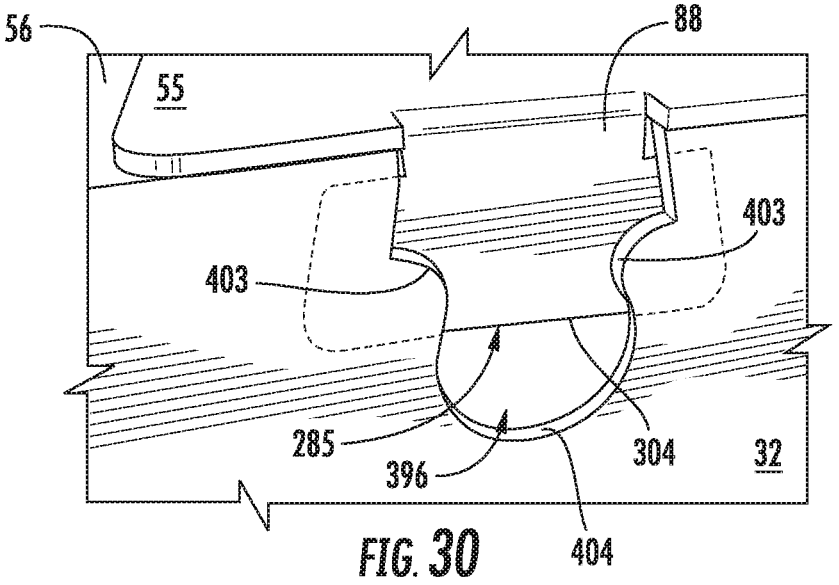
FIG. 30 is like FIG. 29, except for depicting the outer fastener assembly in one of its fastened configurations, in which the outer latching tab extends through and is mated with the outer keeping hole.

FIG. 28 depicts a representative portion of a closed end of a box erected from the blank 20 of FIG. 25. In FIG. 28, the representative outer fastener assembly 285, 396 is in an unfastened configuration. The outer fastener assembly 285, 396 comprises the outer latching tab 285 and the outer keeping hole 396 that are configured for being mated with one another. In FIGS. 28-30, the outer flap 55 overlaps and is in opposing face-to-face relation (e.g., face-to-face contact) with the inner flap 56. The flaps 55, 56 can be at least partially secured (e.g., releasably secured) in their closed configurations by fastening the outer lock or fastener assembly 285, 396. Referring to FIGS. 29 and 30, the outer fastener assembly 285, 396 can be fastened by folding inwardly the outer latching tab 285, and inserting the outer latching tab head 308 through the outer keeping hole 396. Each outer latching tab 285 can be configured to be moved through the respective outer keeping hole 396 in a first direction so that the neck 88 is positioned in the outer keeping hole and the head 308 is restricted from moving outward through the outer keeping hole in a second direction that is opposite the first direction.

Referring to FIGS. 29 and 30, each outer latching tab head 308 can elastically deform as it is passed (e.g., pushed inwardly) through the respective outer keeping hole 396. At least partially reiterating from above, the relatively short side of the trapezoidal head 308 can be adjacent the neck 306 in order to ease the process of deforming the head/inserting the head through the keeping hole 396. After passing through the outer keeping hole 396, the outer latching tab head 308 can elastically return to its original shape (e.g., substantially return to its original shape) so that the outer latching tab 285 is secured in the outer keeping hole 396 to fasten an outer fastener assembly 285, 396 that releasably secures the respective flaps 55, 56 in their inwardly closed configuration.

Figure 31:
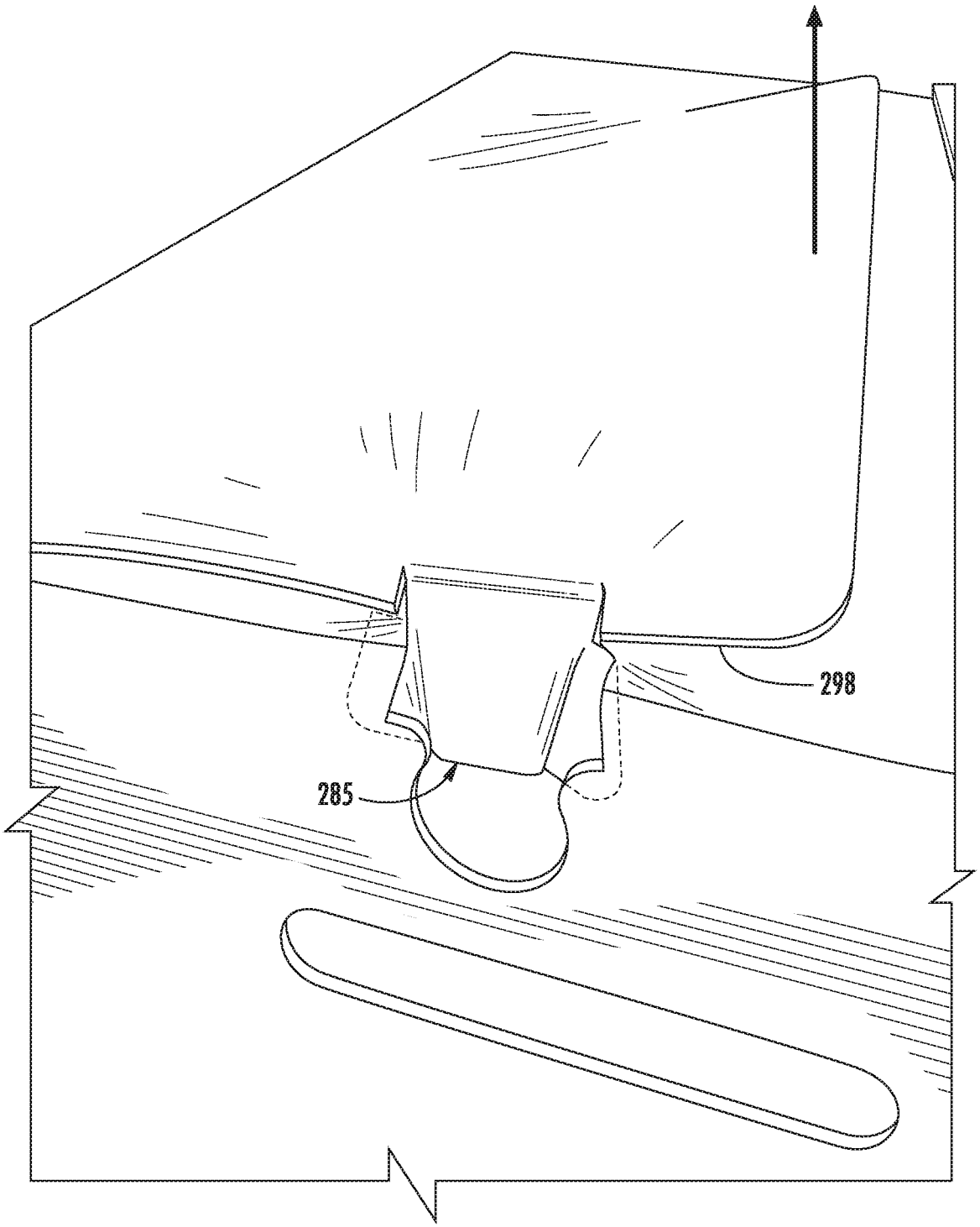
FIG. 31 is like FIG. 30, except that the outer fastener assembly is in a deformed fastened configuration.

FIG. 30 depicts a representative outer fastener assembly 285, 396 in its fastened configuration, wherein hidden edges of the latching tab 285 are schematically illustrated by dashed lines. In the fastened configuration of the outer fastener assembly 285, 396, the neck 88 extends through the portion of the outer keeping hole 396 defined between the edges 401 (FIG. 27), so that the head's outwardly extending engagement edges 310 (FIG. 26) engage the respective interior surface portions of the inner flap 56. In a fastened outer fastener assembly 285, 396, inner faces of the protrusions 403 can respectively be engaged to (e.g., in opposing face-to-face contact with) outer faces of the flaps 314 (FIG. 26) of the latching tab head 308 in a manner that seeks to restrict unfastening of the outer fastener assembly 285, 396. More specifically, inner faces of the protrusions 403 can respectively be engaged to (e.g., in opposing face-to-face contact with) outer faces of the flaps 314 in a manner that seeks to restrict the outer latching tab 285 from inadvertently passing outwardly through the outer keeping hole 396. State differently, each outer fastener assembly 285, 396 is typically secure enough in its fastened configuration to remain fastened during typical usage of the box 22. For example, the convex edges 403 can define protrusions 403, or more specifically arcuate or semicircular protrusions 403, that extend into the outer keeping hole 396 and engage the head 308 in a manner that seeks to restrict the latching tab 285 from unintentionally passing outwardly through the outer keeping hole 396. Reiterating from above, each outer fastener assembly 285, 396 is typically secure enough in its fastened configuration to remain fastened during typical usage of the box 22. For example, FIG. 31 depicts the representative outer fastener assembly 285, 396 in a deformed, but still fastened, configuration.

Figure 32:
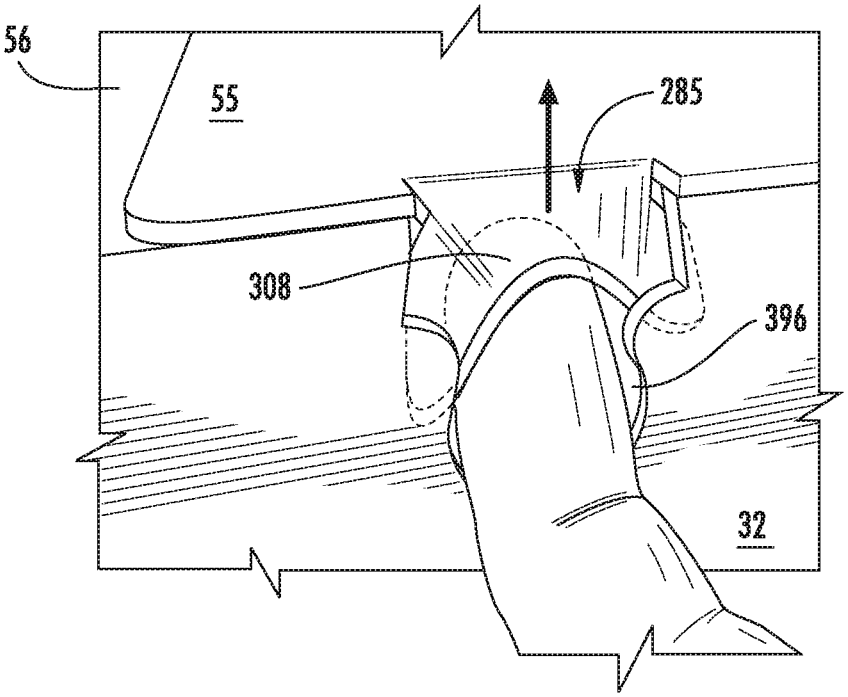
FIG. 32 depicts the fastener assembly of the third embodiment being unfastened.

In the third embodiment, each outer fastener assembly 285, 396 is typically also releasable or openable, by generally reversing the process of fastening the outer fastener assembly, or the like. For example, FIG. 32 depicts the representative outer fastener assembly 285, 396 in the process of being manually unfastened. In the example of depicted in FIG. 30, the outer latching tab 285 obstructs a first portion of the outer keeping hole 396, without obstructing a second portion of the outer keeping hole. The unobstructed second portion of the outer keeping hole 396 can be at least partially defined between a central portion of the edge 304 of the outer latching tab 285 and the edge 404 of the outer keeping hole. As shown in FIG. 32, the unobstructed second portion of the outer keeping hole 396 can be configured for receiving a users' finger, so that the tip of the finger can engage the inner surface of the head 308 of the outer latching tab 285 and pull the outer latching tab 285 outwardly through the outer keeping hole 396 to unfasten the outer fastener assembly 285, 396. Alternatively, the outer fastener assembly 285, 396 can be unfastened in any other suitable manner.

Other embodiments are within the scope of this disclosure. For example, a fourth embodiment can be like the above-described embodiments, except for variations noted and variations that will be apparent to those of ordinary skill in the art.

In the fourth embodiment, for each of the inner fastener assemblies 70, 90, the positions of the inner latching tab 70 and corresponding inner keeping hole 90 can be interchanged. For example and as best understood with reference to FIG. 1, for each of the inner fastener assemblies 70, 90, the positions of the inner latching tab 70 and corresponding inner keeping hole 90 can be interchanged, so that the inner latching tabs 70 are respectively are defined in the inner flaps 52, 54, 56, 58, and the inner keeping holes 90 are respectively defined in the outer flaps 51, 53, 55, 57. Accordingly, the inner latching tabs 70 can be manually pulled outwardly through the respective inner keeping holes 90 to fasten the inner fastener assemblies 70, 90. Therefore and in accordance with the fourth embodiment, FIGS. 10-12 and 18 are illustrative of views from the interior of the box, and FIGS. 13, 14 and 19 are illustrative of views from outside the box.

The boxes of the forth embodiment can be used, for example, to contain celery or any other suitable vegetables. In the fourth embodiment, for fastening the inner fastener assemblies 70, 90, instead of the latching tabs 70 being pushed into the keeping holes 90, the latching tabs 70 are pulled outwardly through the keeping holes 90, from the inner flaps through the outer flaps. For example, this outward pulling of the latching tabs 70 may seeks to prevent damaging the vegetables, for example celery, within the box. Accordingly, it is within the scope of this disclosure for the fastening of the inner fastener assemblies 70, 90 to include pushing and/or pulling of the latching tabs 70 into the keeping holes 90

In the above Detailed Description section of this disclosure, terms such as substantially, proximate, generally and about, or the like, have been included to indicate that the present disclosure embraces variations. For example, variations may be introduced when the blanks 20 are manufactured by passing a web of precursor material through one or more die stations including cutting and scoring dies, or the like. For example, variations may occur as dies wear and/or are replaced, or the like. Those of ordinary skill in the art will understand that, in such a manufacturing process, typically there are engineering tolerances comprising permissible limits in variations of dimensions, and the tolerances can vary in different circumstances. As another example, the boxes 22 can have different (e.g., slightly different) dimensions to accommodate corn size from different seasons, or the like. For example, a relatively large box 22 may be made and used for relatively large spring/ summer corn, and a relatively small box 22 may be made and used for relatively small fall corn.

In accordance with the above-described embodiments, a fold line can be any substantially linear, although not necessarily straight, form of weakening that facilitates folding therealong. More specifically, but not for the purpose of narrowing the scope of this disclosure, fold lines can include: a score line, such as lines formed with a blunt scoring knife, or the like, which creates a crushed portion in the material along the desired line of weakness; a cut that extends partially into a material along the desired line of weakness; a series of cuts that extend partially into and/or completely through the material along the desired line of weakness; various combinations of these features; and/or other suitable features.

In accordance with the above-described embodiments, one or more of the flaps 51, 52, 53, 54, 55, 56, 57, 58 can be numbered. The flaps at a first open end of the box 22, which becomes the box bottom, can be respectively numbered 1-3. The flaps at the opposite open end of the box 22, which become the top side of the box, can be respectively numbered 5-7. The numbered flaps seek to facilitate box assembly by illustrating proper sequence of flap closure. All numbers on the six numbered flaps can be hidden after box closure. The fourth flap on each end may not be numbered as it should be understood to be the fourth and last flap that must be closed.

In accordance with the above-described embodiments, printed logos or generic symbols can be included on the blanks 20 and boxes 22 to help packers and operators stack boxes in better orientation on a pallet. The bottom of the box when packed can become the exterior side when stacked on pallet. The bottom of the box can have two indicating symbols or custom logos while the top when packing can have one indicating symbol or custom logo. This can provide indication or direction for operators and can also provide product promotion and/or identification if the box is unintentionally placed in the less preferred orientation (side with one logo or indicating symbol). This can also be accomplished with printed text, such as "This Side Up, This Side Out."

In accordance with the above-described embodiments, the latching tabs 70, 85, 285 can be more generally referred to as latches and/or tabs, and the keeping holes 90, 96, 396 can be more generally referred to as holes.

In the specification and/or figures, examples of embodiments have been disclosed. The present invention is not limited to such exemplary embodiments. Unless otherwise noted, specific terms have been used in a generic and descriptive sense and not for purposes of limitation. The use of the term "and/or" includes any and all combinations of one or more of the associated listed items.

The invention claimed is:

1. A box, comprising:

a plurality of panels each comprising opposite end edges and opposite side edges extending crosswise to the end edges, wherein the end edges are respectively foldably connected to one another so that the plurality of panels extends at least partially around an interior of the box, and wherein the plurality of panels comprises a first panel and a second panel that are adjacent to one another and foldably connected to one another by a crosswise fold line;

first and second flaps foldably connected to respective side edges of the plurality of panels, the first and second flaps being cooperatively configured to be in at least one overlapping relationship with one another to at least partially close a side of the box, wherein the first flap and the first panel are adjacent to one another and foldably connected to one another by a first fold line, the second flap and the second panel are adjacent to one another and foldably connected to one another by a second fold line, and the crosswise fold line extends crosswise to each of the first and second fold lines; and a fastener assembly configured to provide at least one fastened configuration to releasably fasten the first and second flaps to one another when the first and second flaps are in the at least one overlapping relationship, wherein:

the fastener assembly comprises a latch of the first flap and a hole of the second flap, the latch and the hole are configured to be mated together in the at least one fastened configuration, the latch is inwardly spaced apart from each outer peripheral edge of the first flap, and the hole is inwardly spaced apart from each outer peripheral edge of the second flap.

2. The box according to claim 1, wherein:

the first and second flaps are configured to be in a plurality of predetermined overlapping configurations with one another;

the fastener assembly is a variable fastener assembly configured to be in a plurality of predetermined fastened configurations for respectively releasably securing the first and second flaps to one another in the plurality of predetermined overlapping configurations; and the latch and the hole are configured to be mated together in each of the predetermined fastened configurations.

3. The box according to claim 2, wherein:

the plurality of predetermined overlapping configurations comprises first and second overlapping configurations;

the side of the box bulges farther outwardly in the second overlapping configuration than in the first overlapping configuration; and an area of contact between the latch and the second flap is greater in the second overlapping configuration than the first overlapping configuration.

4. The box according to claim 2, wherein:

the latch comprises a tab of the first flap;

the tab comprises a neck and a head;

the head is configured to be moved through the hole in a first direction so that the neck is positioned in the hole and the head is restricted from moving through the hole in a second direction that is opposite the first direction;

the plurality of predetermined fastened configurations comprises first and second fastened configurations;

the neck is positioned in a first portion of the hole in the first fastened configuration;

the neck is positioned in a second portion of the hole in the second fastened configuration; and the first and second portions of the hole are spaced apart along a dimension of the hole.

5. The box according to claim 4, wherein a dimension of the second portion of the hole is smaller than a corresponding dimension of the first portion of the hole.

6. The box according to claim 4, wherein the neck is positioned closer to an end of the dimension of the hole in the second fastened configuration than in the first fastened configuration.

7. The box according to claim 1, wherein:

the latch comprises a tab of the first flap;

the tab comprises an outwardly extending edge;

the hole is defined in the second flap; and the outwardly extending edge of the tab is configured to be moved through the hole in a first direction so that the outwardly extending edge engages the second flap to restrict the outwardly extending edge from moving through the hole in a second direction that is opposite the first direction.

8. The box according to claim 7, wherein the fastener assembly is configured:

to cause sliding engagement to occur between the outwardly extending edge and the second flap in response to predetermined relative movement between the first and second flaps, and so that the sliding engagement occurs along a dimension of the hole.

9. The box according to claim 7, wherein the fastener assembly is configured to cause sliding engagement to occur between the outwardly extending edge and the second flap in response to outward bulging of the first and second flaps while the first and second flaps are at least partially closing the box.

10. The box according to claim 1, wherein:

the opposite end edges of the first panel are spaced apart from one another in a longitudinal direction;

the first panel comprises a polymeric sheet having elongate flutes extending in the longitudinal direction; and an end edge of the first panel is foldably connected to an end edge of the second panel by the crosswise fold line that extends crosswise to the longitudinal direction.

11. A blank comprising:

a plurality of panels each comprising opposite end edges and opposite side edges extending crosswise to the end edges, wherein at least some of the opposite end edges are respectively foldably connected to one another;

a first flap foldably connected to a side edge of the side edges of a first panel of the plurality of panels, wherein the first flap comprises a tab spaced apart from each outer peripheral edge of the first flap; and a second flap foldably connected to a side edge of the side edges of a second panel of the plurality of panels, wherein the second flap comprises a hole spaced apart from each outer peripheral edge of the second flap, wherein:

the tab and the hole are cooperatively configured to be mated with one another and releasably secure the first and second flaps to one another when the blank is erected into a box, the first flap and the first panel are adjacent to one another and foldably connected to one another by a first fold line, the second flap and the second panel are adjacent to one another and foldably connected to one another by a second fold line, and the first and second panels are adjacent to one another and foldably connected to one another by a fold line that extends crosswise to each of the first and second fold lines.

12. The blank according to claim 11, wherein:

the plurality of panels comprises opposite ends spaced apart from one another in a longitudinal direction;

the plurality of panels comprises elongate flutes extending in the longitudinal direction; and the at least some of the opposite end edges of the plurality of panels are respectively foldably connected to one another by fold lines extending crosswise to the longitudinal direction.

13. The blank according to claim 11, comprising a polymeric sheet having a plurality of flutes extending in a longitudinal direction, wherein:

the polymeric sheet at least partially defines each of the plurality of panels and the first and second flaps, so that each of the plurality of panels and the first and second flaps includes respective flutes of the plurality of flutes; and at least some of the opposite end edges of the plurality of panels are respectively foldably connected to one another by fold lines extending crosswise to the longitudinal direction.

14. The blank according to claim 13, wherein the polymeric sheet is an extruded sheet comprising:

first and second walls that are opposite from one another; and a plurality of web members connected to and extending between the first and second walls, wherein the web members are serially spaced apart from one another in a direction extending crosswise the longitudinal direction.

15. A blank comprising:

a plurality of panels each comprising opposite end edges and opposite side edges extending crosswise to the end edges, wherein at least some of the opposite end edges are respectively foldably connected to one another;

a first flap foldably connected to a side edge of the side edges of a first panel of the plurality of panels, wherein the first flap comprises a tab; and a second flap foldably connected to a side edge of the side edges of a second panel of the plurality of panels, wherein:

the second side panel at least partially defines a hole, the tab and the hole are cooperatively configured to be mated with one another and releasably secure the first and second flaps to one another when the blank is erected into a box, a protrusion of the second panel extends inwardly into the hole, and the protrusion and the tab are cooperatively configured to be engaged with one another when the blank is erected into a box.

16. The blank according to claim 15, wherein:

the tab comprises neck and a head connected to the neck, the head extends in an outward direction away from the neck, and the head defines a taper so that opposite edges of the head extend divergently with respect to one another in the outward direction.

17. The blank according to claim 15, wherein the protrusion comprises an arcuate edge.

18. The blank according to claim 15, wherein:

the hole is at least partially defined by opposite first and second edges of the second panel, so that the hole is positioned between the first and second edges of the second panel, the protrusion is a first protrusion extending inwardly into the hole from the first edge, and a second protrusion of the second panel extends inwardly into the hole from the second edge.

19. The blank according to claim 15 erected into a box, wherein:

the tab and the hole are mated with one another, the tab obstructs a first portion of the hole, a second portion of the hole is not obstructed by the tab and is configured for receiving a user's finger for pulling at least a portion of the tab outwardly through the hole.

20. A box, comprising:

a plurality of panels each comprising opposite end edges and opposite side edges extending crosswise to the end edges, wherein the end edges are respectively foldably connected to one another so that the plurality of panels extends at least partially around an interior of the box;

first and second flaps foldably connected to respective side edges of the plurality of panels, the first and second flaps being cooperatively configured to be in at least one overlapping relationship with one another to at least partially close a side of the box; and a fastener assembly configured to provide at least one fastened configuration to releasably fasten the first and second flaps to one another when the first and second flaps are in the at least one overlapping relationship, wherein:

the fastener assembly comprises a latch of the first flap and a hole of the second flap, the latch and the hole are configured to be mated together in the at least one fastened configuration, the latch is inwardly spaced apart from each outer peripheral edge of the first flap, the hole is inwardly spaced apart from each outer peripheral edge of the second flap the first and second flaps are configured to be in a plurality of predetermined overlapping configurations with one another, the fastener assembly is a variable fastener assembly configured to be in a plurality of predetermined fastened configurations for respectively releasably securing the first and second flaps to one another in the plurality of predetermined overlapping configurations, the latch and the hole are configured to be mated together in each of the predetermined fastened configurations, the latch comprises a tab of the first flap, the tab comprises a neck and a head, the head is configured to be moved through the hole in a first direction so that the neck is positioned in the hole and the head is restricted from moving through the hole in a second direction that is opposite the first direction, the plurality of predetermined fastened configurations comprises first and second fastened configurations, the neck is positioned in a first portion of the hole in the first fastened configuration, the neck is positioned in a second portion of the hole in the second fastened configuration, the first and second portions of the hole are spaced apart along a dimension of the hole, and a dimension of the second portion of the hole is smaller than a corresponding dimension of the first portion of the hole.

21. The box according to claim 20, wherein:

the side of the box bulges farther outwardly in the second overlapping configuration than in the first overlapping configuration; and an area of contact between the latch and the second flap is greater in the second overlapping configuration than the first overlapping configuration.

22. The box according to claim 20, wherein the neck is positioned closer to an end of the dimension of the hole in the second fastened configuration than in the first fastened configuration.

23. The box according to claim 20, wherein:

the tab comprises an outwardly extending edge;

the hole is defined in the second flap; and the outwardly extending edge of the tab is configured to be moved through the hole in a first direction so that the outwardly extending edge engages the second flap to restrict the outwardly extending edge from moving through the hole in a second direction that is opposite the first direction.

24. The box according to claim 23, wherein the fastener assembly is configured:

to cause sliding engagement to occur between the outwardly extending edge and the second flap in response to predetermined relative movement between the first and second flaps, and so that the sliding engagement occurs along a dimension of the hole.

25. The box according to claim 23, wherein the fastener assembly is configured to cause sliding engagement to occur between the outwardly extending edge and the second flap in response to outward bulging of the first and second flaps while the first and second flaps are at least partially closing the box.

26. The box according to claim 20, wherein:

the plurality of panels comprises a first panel and a second panel that are adjacent to one another and foldably connected to one another by a crosswise fold line;

the first flap and the first panel are adjacent to one another and foldably connected to one another by a first fold line;

the second flap and the second panel are adjacent to one another and foldably connected to one another by a second fold line; and the crosswise fold line extends crosswise to each of the first and second fold lines.

* * * * *